US010415236B2

(12) United States Patent
Ryu

(10) Patent No.: US 10,415,236 B2
(45) Date of Patent: Sep. 17, 2019

(54) OUTER INSULATION INTEGRATED INSULATING BLOCK SYSTEM EASY TO DRY-FINISH AND A CONSTRUCTION METHOD THEREBY

(71) Applicant: EZIBS CO., LTD., Pyeongchang-gun (KR)

(72) Inventor: Seung-Woo Ryu, Pyeongchang-gun (KR)

(73) Assignee: EZIBS CO., LTD., Pyeongchang-gun (KR)

( * ) Notice: Subject to any disclaimer, the term of this patent is extended or adjusted under 35 U.S.C. 154(b) by 0 days.

(21) Appl. No.: 15/743,663

(22) PCT Filed: Mar. 29, 2016

(86) PCT No.: PCT/KR2016/003213
§ 371 (c)(1),
(2) Date: Jan. 10, 2018

(87) PCT Pub. No.: WO2017/171111
PCT Pub. Date: Oct. 5, 2017

(65) Prior Publication Data
US 2018/0202149 A1 Jul. 19, 2018

(51) Int. Cl.
*E04B 1/78* (2006.01)
*E04B 2/86* (2006.01)
(Continued)

(52) U.S. Cl.
CPC ..... *E04B 1/78* (2013.01); *E04B 2/8647* (2013.01); *E04F 13/047* (2013.01);
(Continued)

(58) Field of Classification Search
USPC ..... 52/309.4, 309.7, 309.11, 309.12
See application file for complete search history.

(56) References Cited

U.S. PATENT DOCUMENTS 5,809,726 A * 9/1998 Spude ..... E02D 27/02 52/274
8,756,890 B2 * 6/2014 Ciuperca ..... E04B 1/21 52/426
(Continued)

FOREIGN PATENT DOCUMENTS

JP H11-029993 A 2/1999
JP 11-172820 A 6/1999
(Continued)

OTHER PUBLICATIONS

International Search Report for PCT/KR2016/003213.
Written Opinion of the International Search Authority for PCT/KR2016/003213.

*Primary Examiner* — Brian E Glessner
*Assistant Examiner* — Adam G Barlow
(74) *Attorney, Agent, or Firm* — Monami Law Group PLLC; Eunyoung Lee

(57) ABSTRACT

The present invention relates to a method for replacing a conventional mold construction, and includes a plate-shaped outer insulating material, an inner plywood (or a board-shaped finishing material), a connection unit, and a lightweight temporary material. According to the present invention, a wall is constructed by connecting the inner plywood to the lightweight temporary material from a corner foundation surface and by laying bricks. Reinforcement bars are placed after an interior wall is constructed and arranged to cross each other or to align with each other as instructed in a design specification. Then, an exterior wall is installed corresponding to the connection unit connected to the inner plywood. As a result, a wall having a thermal bridge prevention effect and a higher quality is obtained. Either dry finish or a wet finish is applicable to the wall.

11 Claims, 16 Drawing Sheets

(51) Int. Cl.

| | |
|---|---|
| ***E04F 13/04*** | (2006.01) |
| ***E04F 13/08*** | (2006.01) |
| ***E04G 17/065*** | (2006.01) |
| ***E04G 17/14*** | (2006.01) |
| *E04C 2/04* | (2006.01) |
| *E04C 2/24* | (2006.01) |

(52) U.S. Cl.

CPC ..... *E04F 13/083* (2013.01); *E04G 17/0654* (2013.01); *E04G 17/14* (2013.01); *E04B 2/8629* (2013.01); *E04B 2/8652* (2013.01); *E04B 2002/8682* (2013.01); *E04B 2002/8688* (2013.01); *E04C 2/044* (2013.01); *E04C 2/243* (2013.01)

(56) References Cited

U.S. PATENT DOCUMENTS

| | | | | |
|---|---|---|---|---|
| 9,074,379 | B2 * | 7/2015 | Ciuperca | E04G 9/10 |
| 2008/0005991 | A1 * | 1/2008 | Meilleur | E04B 2/8635 52/426 |
| 2009/0057518 | A1 * | 3/2009 | Russell | E04G 17/002 248/354.1 |
| 2013/0119228 | A1 * | 5/2013 | Kamata | E04B 2/8635 249/15 |

FOREIGN PATENT DOCUMENTS

| | | | | |
|---|---|---|---|---|
| JP | 11172820 | A | * | 6/1999 |
| JP | 2009-035902 | A | | 2/2009 |
| KR | 10-0375319 | B1 | | 3/2003 |
| KR | 10-0421058 | B1 | | 3/2004 |
| KR | 10-2006-0088919 | A | | 8/2006 |
| KR | 10-2007-0041282 | A | | 4/2007 |
| KR | 10-1027973 | B1 | | 4/2011 |
| KR | 10-1079646 | B1 | | 11/2011 |
| KR | 10-2014-0047794 | A | | 4/2014 |
| KR | 10-1441399 | B1 | | 9/2014 |
| KR | 10-1551256 | B1 | | 9/2015 |

* cited by examiner

OUTER INSULATION INTEGRATED INSULATING BLOCK SYSTEM EASY TO DRY-FINISH AND A CONSTRUCTION METHOD THEREBY

CROSS-REFERENCE TO RELATED APPLICATION

This application is the National Stage of International Application No. PCT/KR2016/003213 filed on Mar. 29, 2016, which is herein incorporated by reference in its entirety.

TECHNICAL FIELD

The present invention relates to a method of constructing a wall in a reinforced concrete structure and more particularly, to insulation block system and a construction method using it which allows integrated exterior insulation and facilitated dry finish.

BACKGROUND ART

In a typical reinforced concrete residential building, a wall is constructed using a mold made of euro form or plywood. Inner molds are placed spaced apart from each other by a given distance corresponding to a thickness of the wall. Reinforcement bars are installed between the inner molds. An outer mold is coupled to an inner mold. Concrete slurry is poured and cured. Then, the inner and outer molds are removed.

In recent years, consumers are increasingly concerned about the increase in heating energy costs due to rising oil prices. As the government's regulations on insulation design are strengthened due to changes in energy design standards of buildings, inner and outer insulations are separately installed on a wall of a reinforced concrete building.

A reinforced concrete structure is advantageous in structural stability due to high durability, but it is hotter in summer and colder in winter due to its good heat storage property. In order to compensate for this, the external insulation method is employed as a solution to improve insulation while preserving its structural stability. However, there is still a concern of faulty construction due to aging of skilled labors, a shortage of manpower, and a long-rooted in-site practice that construction workers are relying on their own personal experiences rather than following given standard specifications.

In addition, a conventional method of building the concrete wall first and then additionally installing the external heat insulation is disadvantageous in that the process is complicated and an additional construction time is required. On top of that, the in-site practice of relying on individual labors) personal experience rather than following a clear standard may cause issues, for example, a poor adhesive strength due to use of insufficient amount of adhesive, a detachment of an insulation material due to use of a fastener which fails to meet given specifications.

A technique of building a wall in an exterior-insulation-integrated manner is proposed. This technique employs an outer mold and an insulation material is attached to the outer mold.

However, since the concrete wall construction employing the external-insulation integration method is carded out by merely attaching general styrofoam produced in the factory to a mold, cement paste penetrates between heat insulating materials when concrete is poured, causing continuous linear thermal bridge. Metal flat ties are used to connect the molds to each other, to fix the molds, and to keep the molds spaced apart by a given distance. The metal flat ties remain even after the molds are removed, causing continuous point thermal bridges.

A given heat ins dating material has a guaranteed heat transfer rate. However, its actual heat insulation performance may vary depending on what method is used. In particular, a thermal bridge between insulation materials may degrade beat transfer rate of a given heat insulating material. Another issue is it is not easy to procure a proper connection material in the market. To take a full advantage of the guaranteed thermal insulation performance, the thermal bridging between insulation materials should be minimized and a connection material, which connects an insulation material and a wall, must have low thermal conductivity Recently, an interest in a passive house construction method increases, and many architects wishing to build houses with high insulation performance is increasing. However, due to lack of construction materials and high construction cost, this method is not still popular in the construction market.

Issues related to a conventional heat insulating system will be described below.

Korean Patent No. 0375319 discloses a device shown in FIG. 1. Inner and outer heat insulating plates, in combination, form an integrated block. Therefore, it is convenient to build. Also, it is advantageous in minimizing deformation due to lateral pressure applied when concrete is poured. However, its structural stability is not good and the inner and outer wall connection blocks 3 and 4 takes up a large volume, reducing a space for a concrete wall. In addition, such structure reduces a coating surface. The reduced coating surface increases a risk of corrosion of reinforcement bars. Also, nails (not shown), which are used for fixing the wedges 5 and 6, likely causes a point thermal bridge and an insulation loss. The wedges 5 and 6 connect upper and lower blocks to each other. The block is formed of one body and takes up a large volume. The lame volume makes a carrying cost and a distribution cost expensive.

Korean Patent No. 1027973 discloses a device shown in FIG. 2. Upper and lower panels are connected to each other by engagement holes (not shown) formed in a cross (+) shape. A construction bridge (28) connects the inner panel (11) and the outdoor panel (12) and is made of a bent metal wire. Styrofoam (Neopor) may be used as an insulation panel to obtain a required insulation performance. However, a contact area between the metal wire for connection and the Styrofoam is small. Thus, when concrete is poured, the Styrofoam is easy to be torn out or the metal wire is likely detached by the pressure of the concrete. Furthermore, when the construction bridge (28) is located away a center of the heat insulating panel, a long-term heat loss may occur due to a heat bridge with an outside air.

Korean Patent No. 1079646 discloses a device as shown in FIG. 3. An outer composite panel (100) and an inner composite panel (200) have heat insulating performance and are connected, to each other through a coupling auxiliary key (300) and a coupling ring (400). The inner and outer composite panels (100 and 200) are spaced apart from each other and withstand lateral pressure (horizontal pressure applied to a vertical member of a mold due to fluidity of concrete when the concrete is poured). The size of the metallic coupling protrusion (310) is small compared to the size of the composite panels, and thus the metallic coupling protrusion (310) is likely dislocated due to lateral pressure applied by the concrete. Furthermore, since upper and lower members have no separate recessed grooves, a heat bridge between the members is unavoidable. To avoid this, a caulking (700) has been provided. The caulking (700) is provided to prevent contamination due to leakage of cement paste and prevent cracks between seams, not to bond and insulate the composite panels. Thus, the caulking dislocates and water leaking occurs over time, and thereby beat insulating performance deteriorates.

DETAILED DESCRIPTION OF THE INVENTION

Problems to be Solved

To address these issues, the present invention uses a connecting unit for a heat insulating block. As a result, a reinforced concrete structure can be built with a high level of external heat insulation. According to this invention, a construction process is simplified and thus can reduce the construction cost. Also, the construction process is standardized and thus, even the general public, who are not professional technicians, may build a wall meeting the <standard specification of Korean Ministry of Land, Transport and Tourism>. With a heat insulation technology according to the present invention, a high-efficiency insulation building and a high-energy performance building can be made.

Solution to Solve the Problems

In order to address the issues of conventional art described above, the present invention provides an insulating block system comprising: a first panel (20) defining a first surface of a wall and including first and second coupling insert grooves (21), wherein the first and second coupling insert grooves are formed (i) at left and right sides, (ii) at top and bottom, or (iii) at top and bottom and, at left and right sides and are spaced apart from each other by a predetermined distance; a connection unit (200) fixed to the first panel, temporary structure (S1, S2, S3) detachably fixed to the first panel by the connection unit and supporting a side pressure of a concrete; and a structure defining a second surface of the wall which faces an inner surface of first panel, spaced apart from the first panel, and fixed by a tie (300, 400), wherein the tie is engaged with the connection unit, wherein the connection unit (200) includes: a panel binder socket (201) coupled to a first end of the tie (300, 400) and fixed to the inner surface of the first panel; and a bolt (202, 203, 204) provided on an outer surface of the first panel, coupled to the panel binder socket (201) to fix the first panel (20) to the panel binder socket (201), and fixing the temporary structure to the outer surface of the first panel.

The structure defining the second surface of the wall is a second panel (20).

The structure defining the second surface of the wall is a heat insulating plate (10), and a connector (100) is installed in the heat insulating plate (10) and coupled to a second end of the tie (300).

The connector (100) may include an inner plate (102) and an outer plate (101) which are spaced apart from each other with a gap corresponding to a thickness of the heat insulating plate (10), wherein the heat insulating plate (10) includes a lower heat insulating plate and an upper heat insulating plate, wherein an upper surface of the lower insulating plate is inserted up between the inner plate (102) and the outer plate (101), wherein a lower surface of the upper insulating plate is inserted down between the inner plate (102) and the outer plate (101), wherein the inner plate (102) faces the wall, wherein the outer plate (101) is exposed to outside; a binder groove (102*ch*, 102*dh*) formed in a binder (102*c*, 102*d*) and engaged with the second end of the tie (300), wherein the binder (102*c*, 102*d*) is formed on a first surface of the inner plate (102), wherein the first surface of the inner plate (102) faces the wall; an insert bar (103) which is in a vertical flat plate shape and connects the inner plate (102) and the outer plate (101) to each other, wherein a lower portion of the insert bar (103) is inserted into a first insert groove (11) formed in the lower heat insulating plate to a first given depth in a first direction perpendicular to an upper surface of the lower heat insulating plate, wherein an upper portion of the insert bar (103) is inserted into a second insert groove (11) formed in the upper heat insulating plate to a second given depth in a second direction perpendicular to a lower surface of the upper heat insulating plate; and a stopper protruding inwardly from a second surface of the inner plate or a first surface of the outer side plate in a third direction, wherein the third direction is perpendicular to the inner plate (102), the outer side plate (101), and the insert bar (103), wherein the second surface of the inner plate and the first surface of the outer plate face each other, wherein the stopper is formed at a midway level between a top and a bottom of the inner plate or the outer plate, wherein bottom of the stopper contacts the upper surface of the lower heat insulating plate and define a first insertion depth up to which the lower heat insulating plate is inserted, wherein top of the stopper contacts the lower surface of the upper heat insulating plate and define a second insertion depth down to which the upper heat insulating plate is inserted.

The panel binder socket (201) may include a surface facing the panel and an opposite surface; a socket nut (201*b*) formed on the surface facing the panel and engageable with the bolt, wherein the bolt is inserted through the first panel from the outer surface of the first panel via a coupling insert groove (21); and a panel binder (201*c*) formed on the opposite surface and engageable with the tie (300, 400).

A panel coupling (205) is provided in the coupling insert groove (21). A female coupling screw (205*a*) is provided in the panel coupling (205). The female coupling screw (205*a*) has a diameter engageable with a screw (600*a*) of a coupling panel wrench (600). The bolt has a smaller diameter than the female coupling screw (205*a*) and does not engage with the female coupling screw (205*a*). A coupling stick (205*c*) protrudes from the panel coupling (205) and faces the panel binder socket (201). A socket groove (201*a*) is formed on the panel binder socket (201) and faces panel coupling (205). The coupling stick (205*c*) is inserted into the socket groove (201*a*).

The bolt may include a socket bolt (202) coupled to the panel binder socket (201) and fixing the panel binder socket (201) to the first panel (20); a middle bolt (203) coupled to a head nut portion (202*b*) formed on the head (202*a*) of the socket bolt (202) and fixing the temporary structure (S1) to the outer surface of the first panel (20) with having the temporary structure (202) interposed between the first panel (20) and the middle bolt (203); and a hex bolt (204) coupled to a head nut (203*b*) formed on a head (203*a*) of the middle bolt (203) and fixing the temporary structure-(S2) to the temporary structure (S1) with having the temporary structure (S2) interposed between the temporary structure (S1) and the hex bolt (204).

A third panel is provided adjacent to and arranged with the first panel side by side. First, and third grooves are formed on side surfaces of the first panel (20) and the third panel, respectively, and face each other, wherein a panel pin (520)

fits in the first and the second grooves. A fourth panel is provided adjacent to and in perpendicular to the first panel. A fourth groove is formed on a side surface of the fourth panel and faces the first groove. A rib (501) of an out-corner member (500) or a rib (511) of an in-corner member (510) fits in the first and the third groove.

Each of the out-corner member (500) and the in-corner member (510) includes an extension which extends over and covers outer surfaces of the first and the fourth panels by a predetermined length.

A leveling device (700) is provided at a lower portion of the first panel. A leveling bolt (710) coupled to the leveling device (700), arranged in a direction toward the ground, and adjusting a coupling depth of the leveling bolt to adjust a horizontal level of the first panel.

According to an embodiment, a method of constructing a wall using the insulating block system includes: installing the first, panel (20) and installing the temporary structure (S1, S2, S3) on the outer surface of the first panel to define the first, surface of the wall; disposing the reinforcement bar (DB1, DB2) in a space defined by the first surface of the wall; defining the second surface of the wall using the tie (300, 400) after disposing the reinforcement bar; providing concrete in a space between the first surface and the second surface of the wall and curing the concrete; and separating the temporary structure (S1, S2, S3).

The second surface of the wall is defined by the heat insulating plate (10) and the connector (100). After the concrete is cured, a dry finish is made on the outer plate (101) of the connector (100). The outer plate (101) is exposed to outside of the heat insulating plate (10).

After the temporary structure is separated, the first panel is not separated but remains. A finish work is made directly on the first panel.

Advantages of the Invention

For better insulation, a structure can constructed using an integrated system. However, the experts hesitate to use this method because an integrated installation uses a conventional plate-shaped insulation material, and cement paste flows out from between the insulation materials under this structure. Thus, a continuous linear thermal bridge occurs. In addition, according to the conventional method, a connection hardware such as a tie is exposed to outside of the insulation material, causing a point thermal bridge.

As an alternative, an outer insulation is separately installed after cure of a wall structure. Companies and workers employing the alternative method tend to follow their own protocols, which are different depending on companies and workers, rather than a uniform standard protocol. Thus, it is difficult to expect a uniform quality.

In addition, a finish material remains even after outer heat insulating construction completes. This makes difficult to adhere a finish material to the insulating material without damaging the heat insulating material.

In contrast, according to an embodiment of the present invention, an integrated single-body casting method may prevent the cement paste from flowing out to outside. The present invention uses as a connection hardware a connecting unit capable of blocking a point thermal bridge, thus improving heat insulating performance of an entire wall. A dry finish is made using a connector compatible with exterior heat insulation. Thus, the dry finish can be performed without damaging the heat insulating material.

In addition, an employment of a lightweight material (synthetic resin), which is much lighter than a conventional mold (euro form) and a temporary structure, can simplify an installation process, reduce a construction workforce, shorten a construction period, and thus reduce a total construction cost.

An employment of standard insulation panels and connection units that, meet the specification of <Standard Specification of Korean Ministry of Land, Transport and Tourism> makes possible to construct a higher quality and higher efficiency building, compared with a conventional method which relies on individual labors' personal experience. Its high energy performance qualifies a low-carbon green technology.

According to an external heat insulation method according to an embodiment of the present invention, an installation process of reinforcement bars is also simplified. A finish process of the exterior heat insulation can be done without disassembling a mold. Thus, construction labors can be saved and a construction period is shortened.

DETAILED DESCRIPTION OF THE INVENTION

The above objectives, features, and advantages of the present invention will become more apparent from the following embodiments of the present invention with reference to the accompanying drawings.

Heat insulating block system, that makes dry-finish easy, according to an embodiment of the present invention will be described in details with reference to the accompanying drawings below.

Figure 1A:
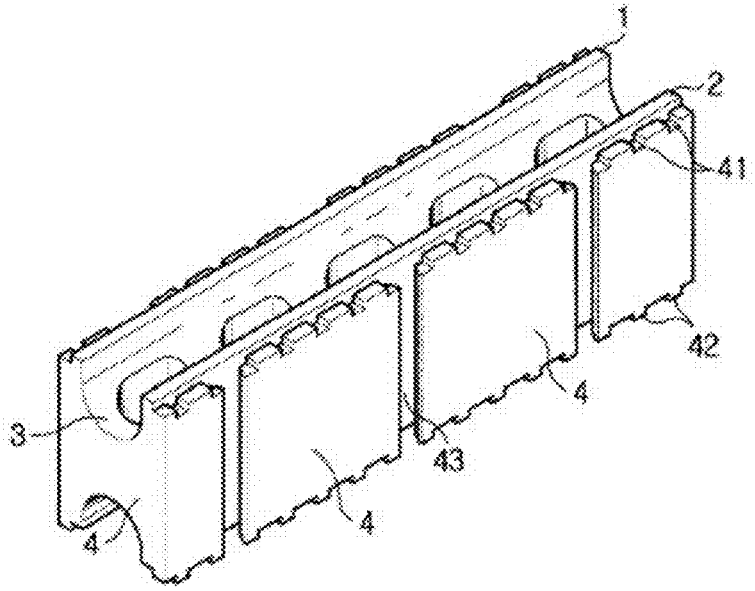
FIG. 1A (Prior Art)
FIGS. 1 to 3 show perspective views of conventional heat insulating members or blocks.
Figure 1B:
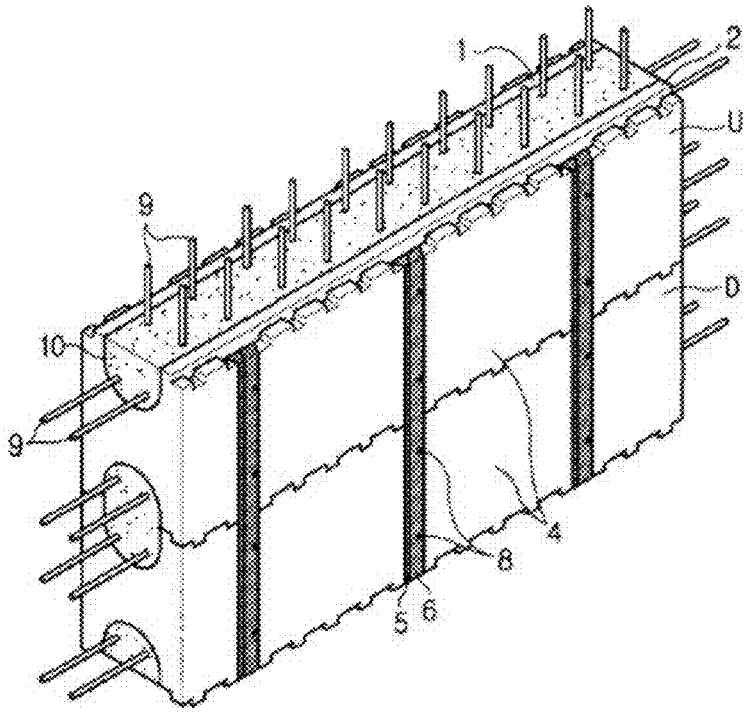
FIG. 1B (Prior Art)
Figure 2A:
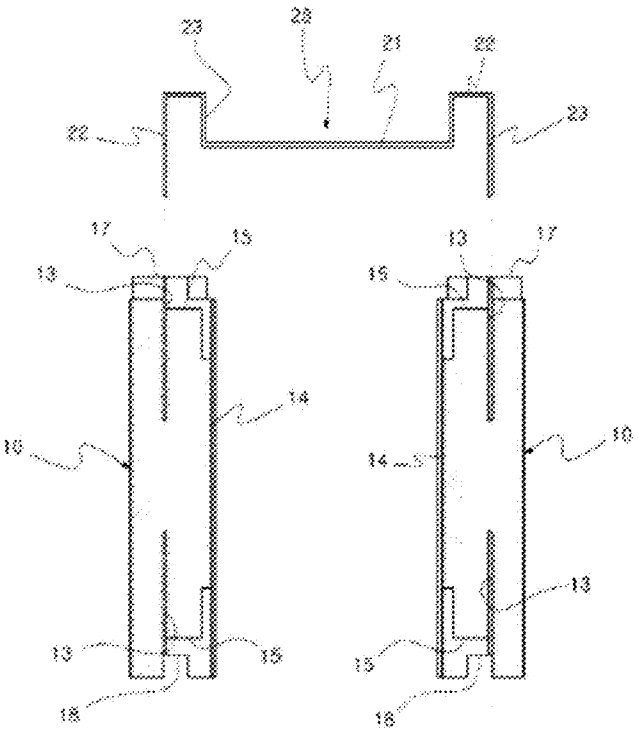
FIG. 2A (Prior Art)
Figure 2B:
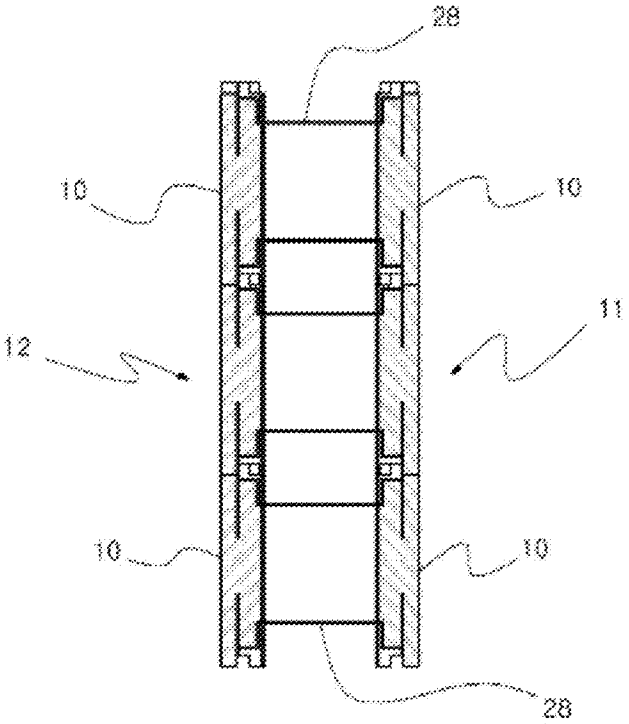
FIG. 2B (Prior Art)
Figure 3A:
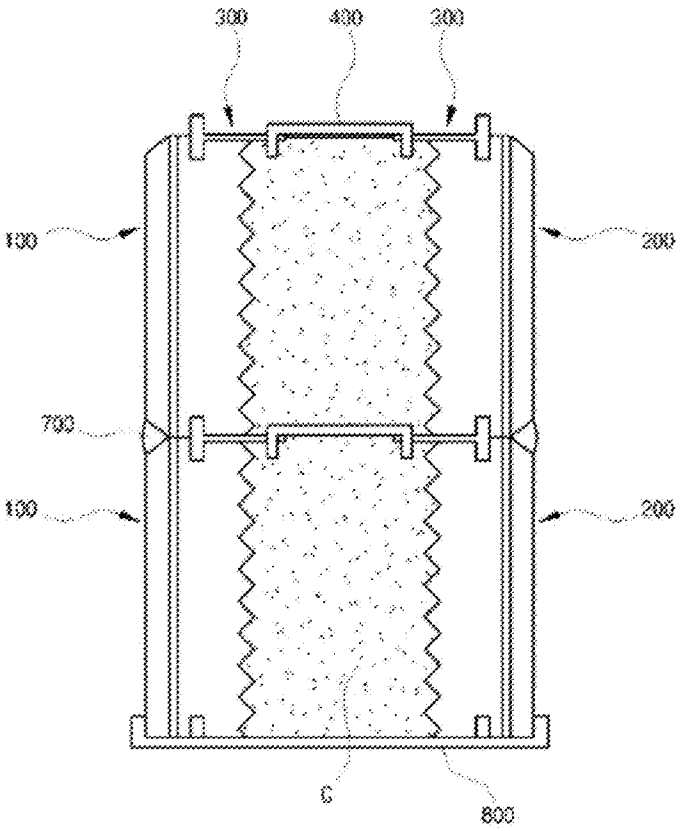
FIG. 3A (Prior Art)
Figure 3B:
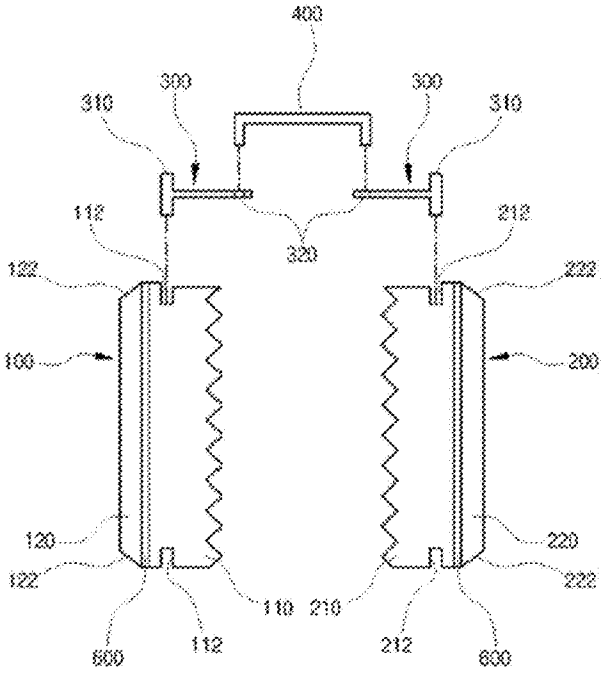
FIG. 3B (Prior Art)
Figure 4:
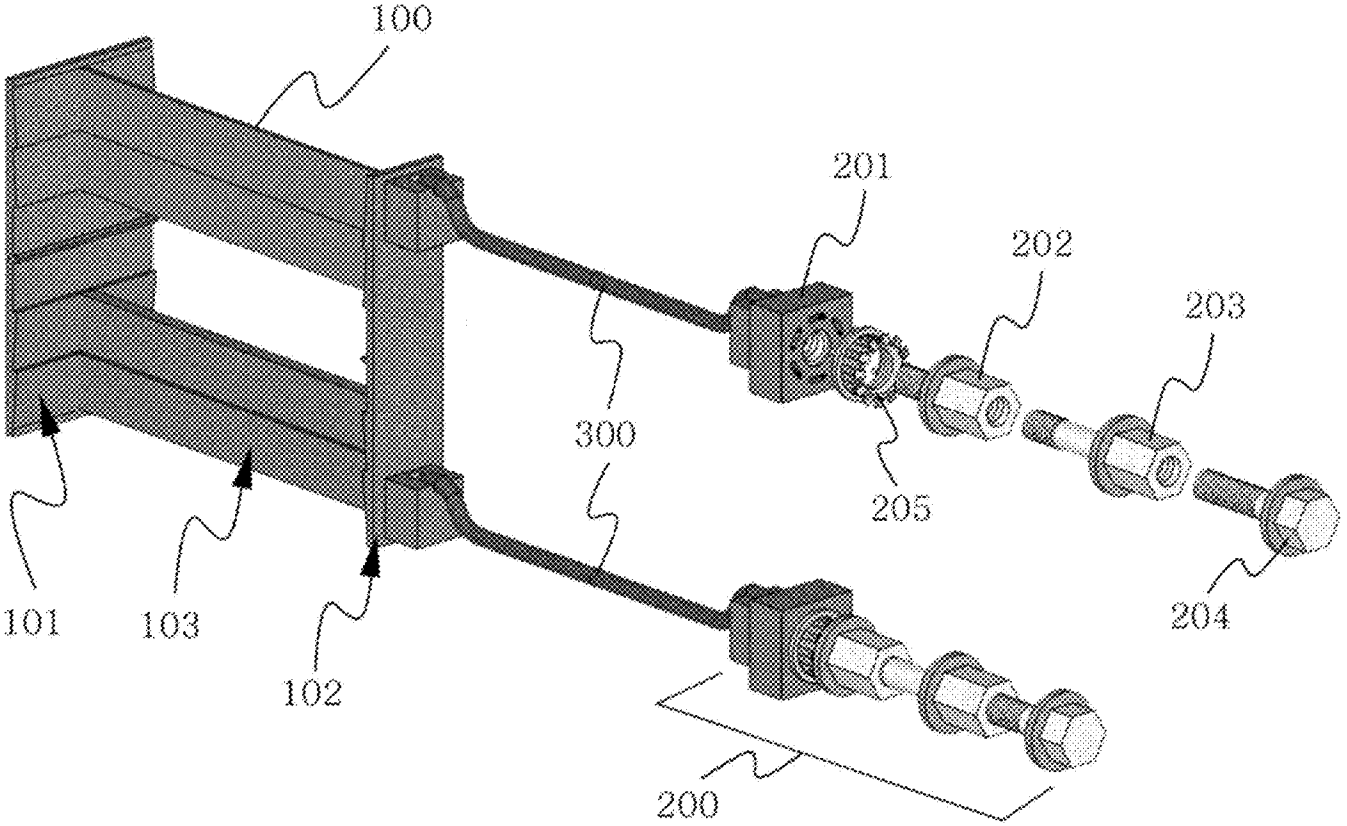
FIGS. 4 and 5 are a perspective view and a detailed view of a connector and a connection unit, respectively, wherein the connector connects an insulation plate (not shown) to a panel (not shown) constituting an outer wall.
Figure 5:
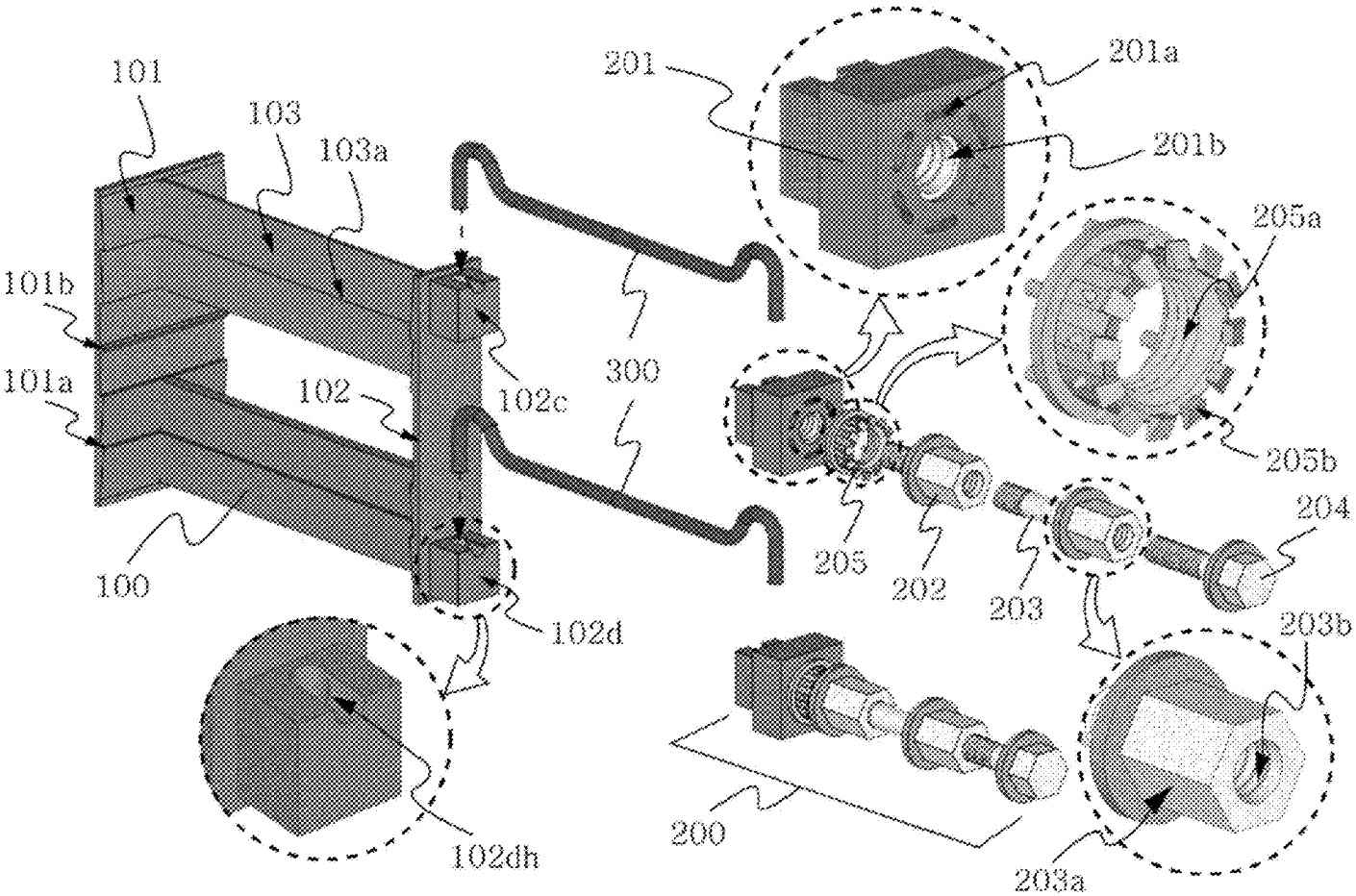
Figure 6:
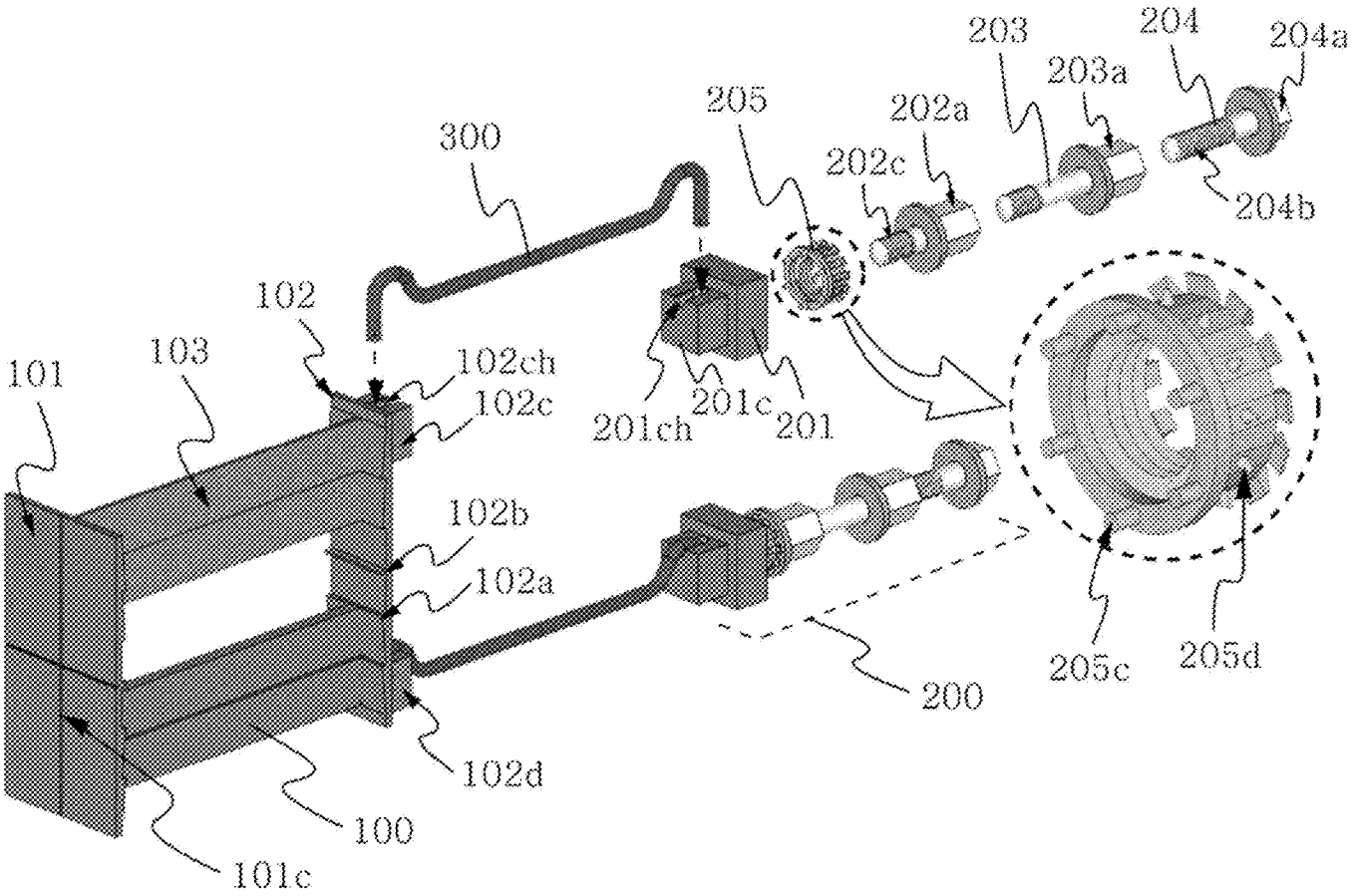
FIG. 6 is another perspective view of the devices shown FIG. 5.
Figure 7:
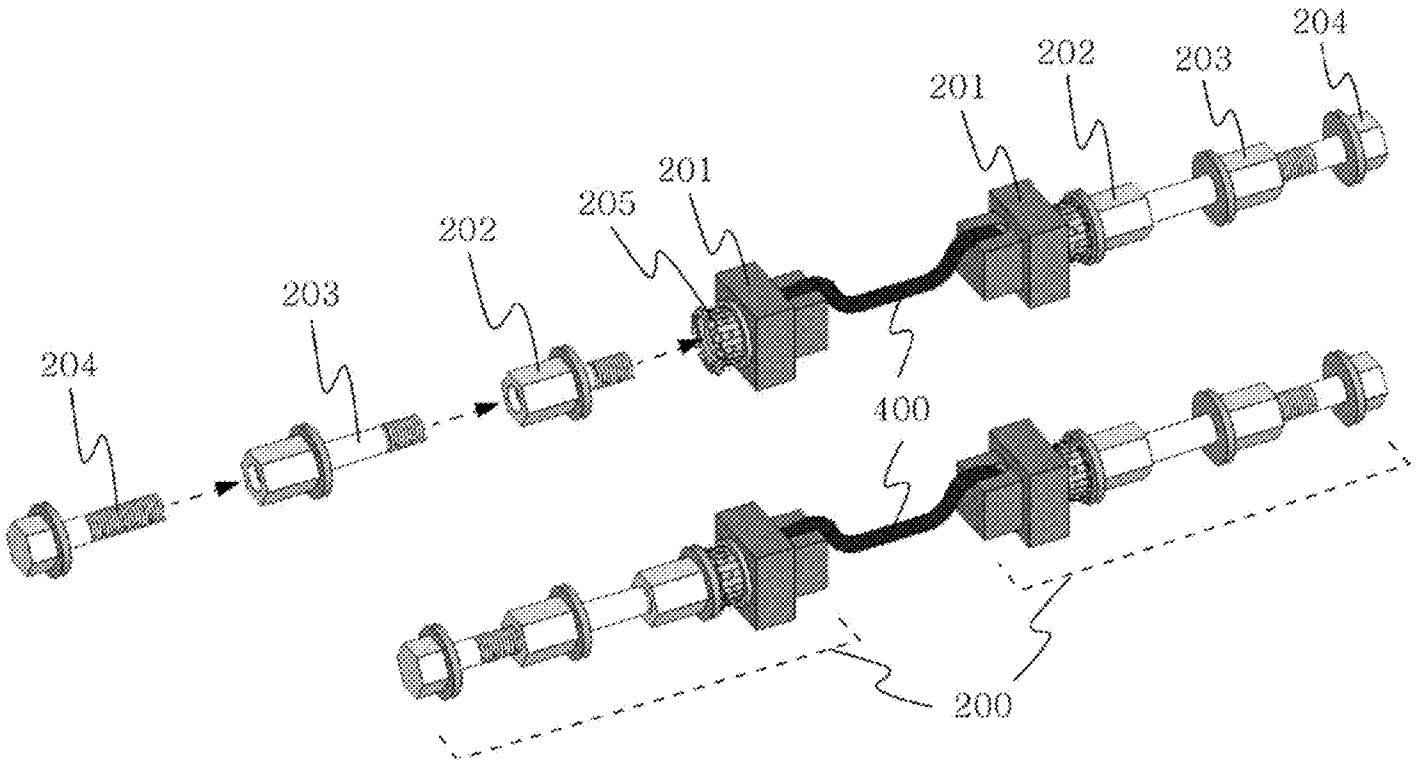
FIG. 7 is a perspective view showing how to install two connection units, where in a pair of panels constituting an inner wall is not shown.
Figure 8:
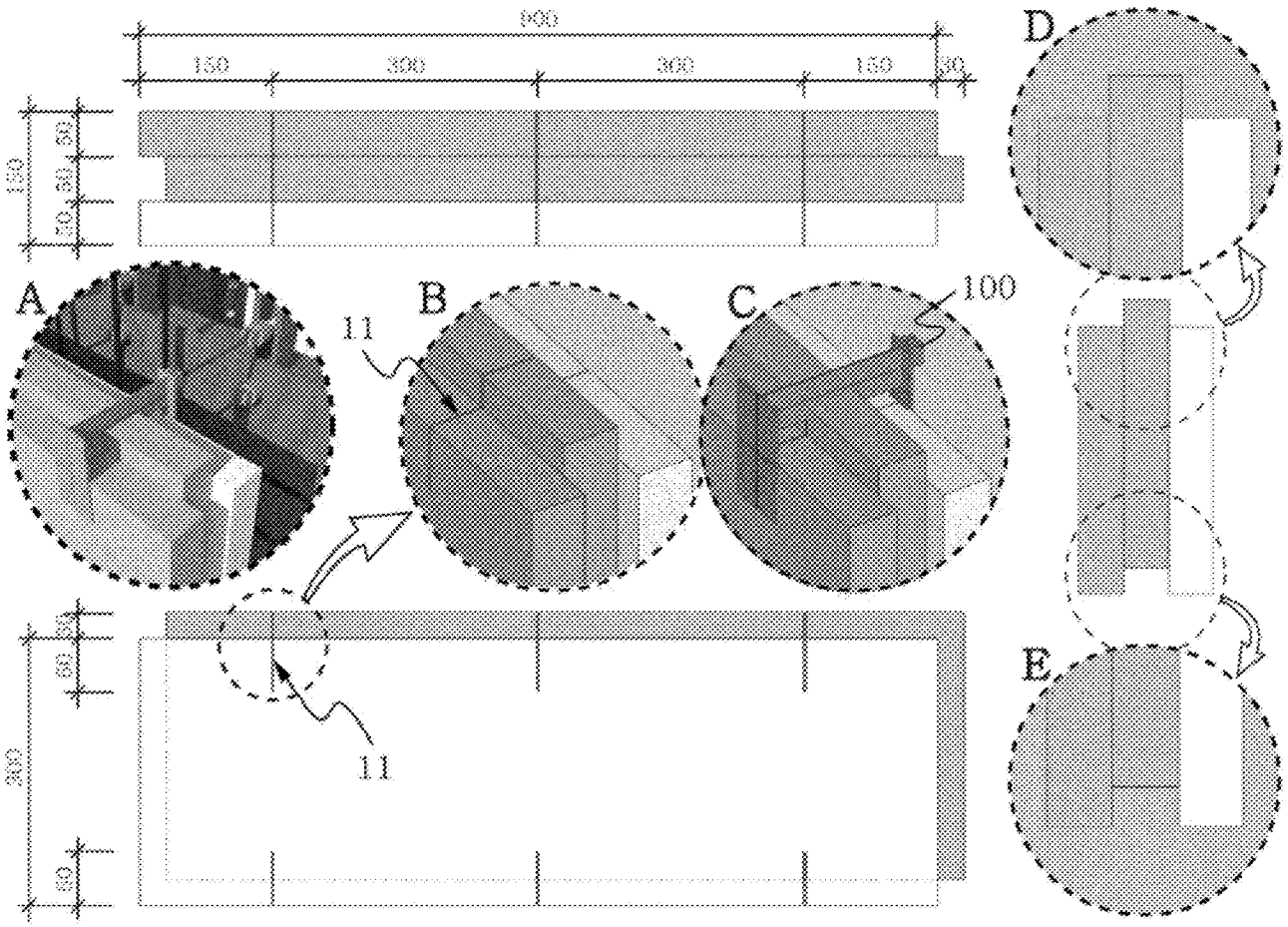
FIG. 8 is a detailed view showing a heat insulating plate according to an embodiment, an insert groove into which a connector is inserted, a spacing between connector insert grooves, how the connector is installed, and how an insulation plate and a connector are coupled to each other.
Figure 9:
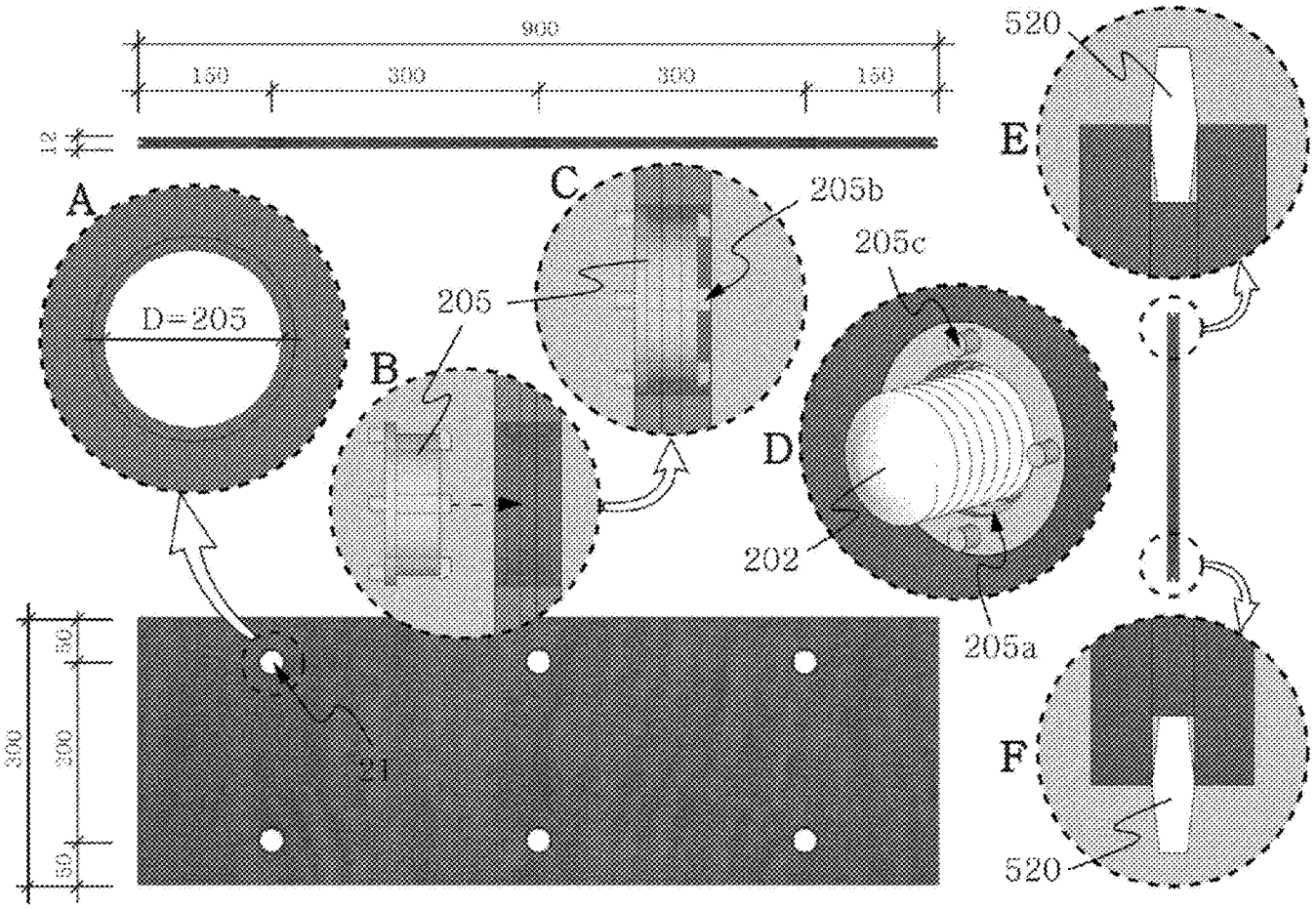
FIG. 9 is a perspective view of an embodiment of the present invention and illustrates a panel with a panel coupling insert groove, how to install a panel coupling into the panel coupling insert groove of the panel, a spacing between panel coupling insert grooves, and panel pins that are inserted into corners at which neighboring panels meet to secure the neighboring panels to each other.
Figure 10:
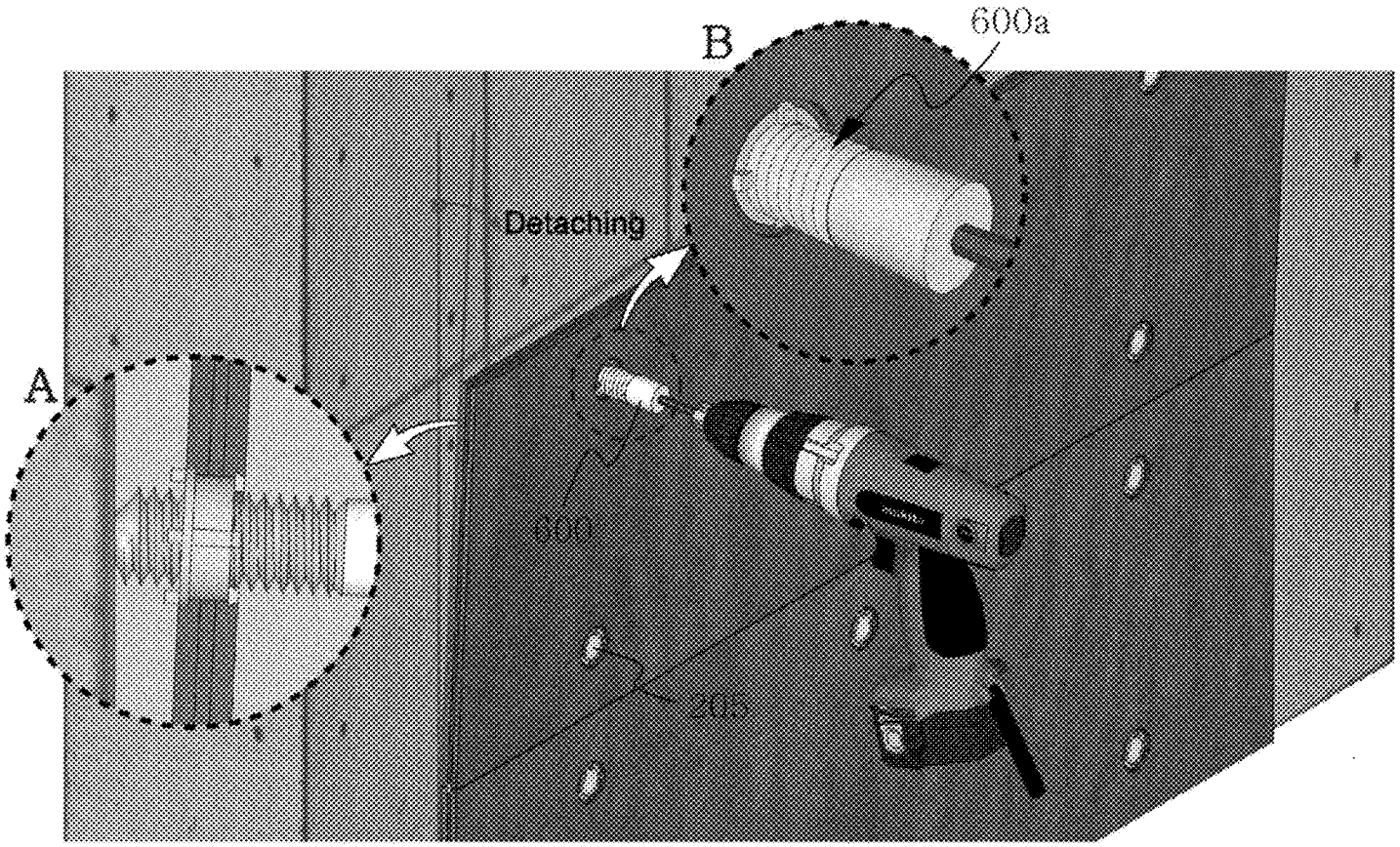
FIG. 10 is a perspective view showing a function of a panel coupling, how to disassemble a panel (plywood), and how to detach a panel contacting with a wall after completion of a wall.
Figure 11:
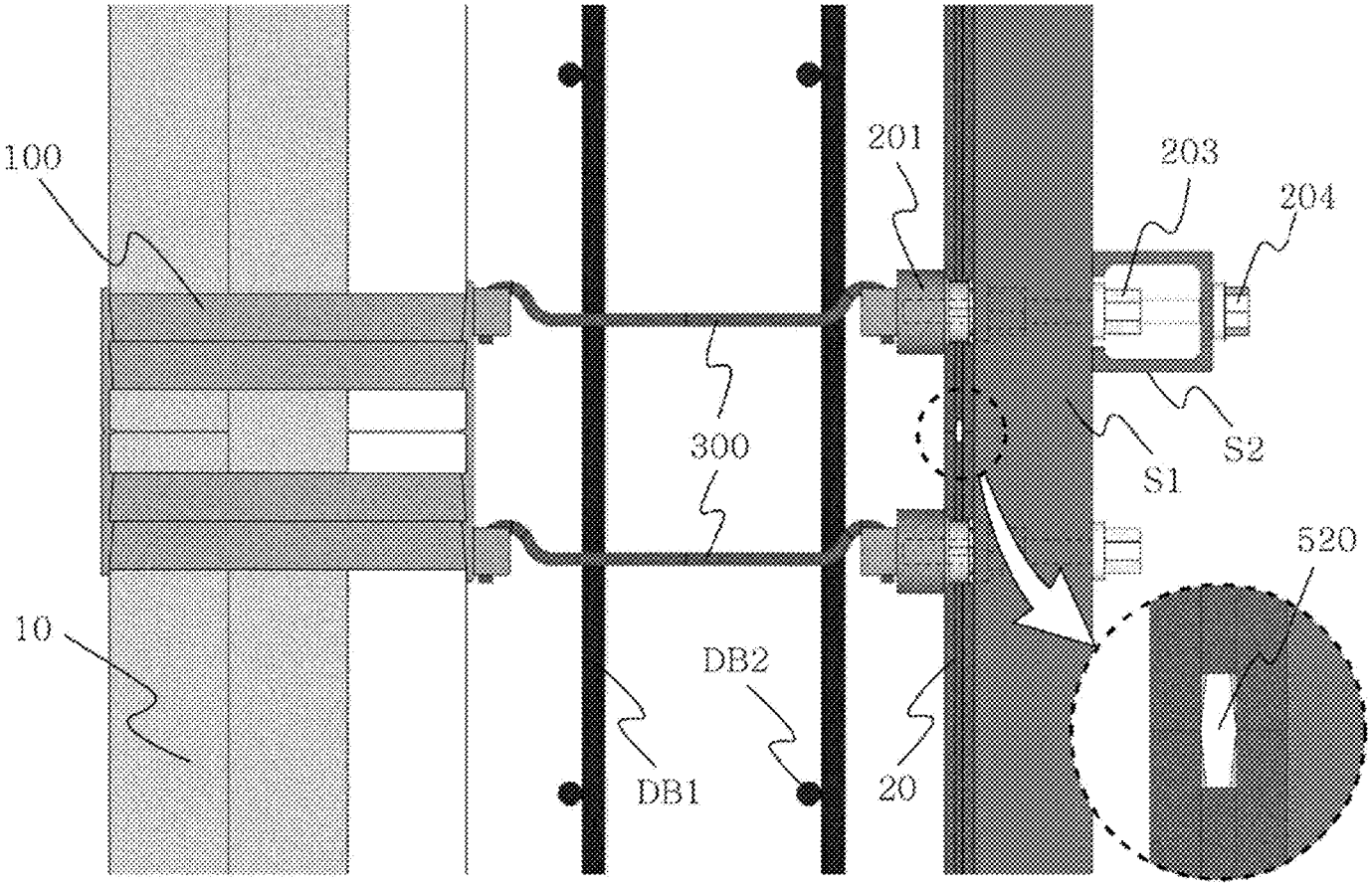
FIG. 11 is a cross-sectional view illustrating how to connect a heat, insulating plate, a panel, and a temporary structure, how to place a reinforcement bar, and how to couple a panel using a heat insulating block system to build an outer wall according to an embodiment of the present invention.
Figure 12:
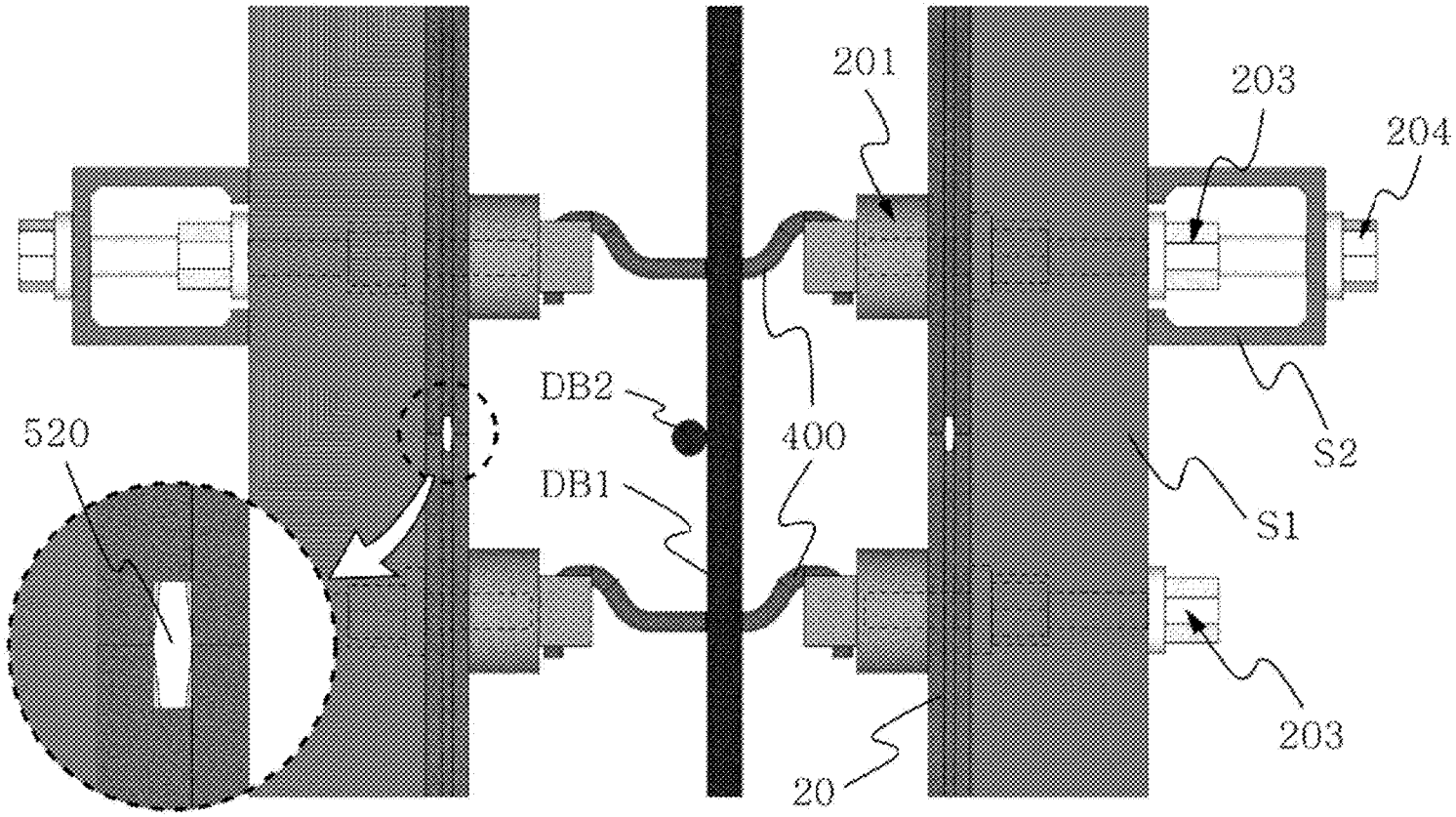
FIG. 12 is a cross-sectional view illustrating how to connect a heat insulating plate, a panel, and a temporary structure, how to place a reinforcement bar, and how to couple a panel using a heat insulating block system to construct an inner wall according to an embodiment of the present invention.
Figure 13:
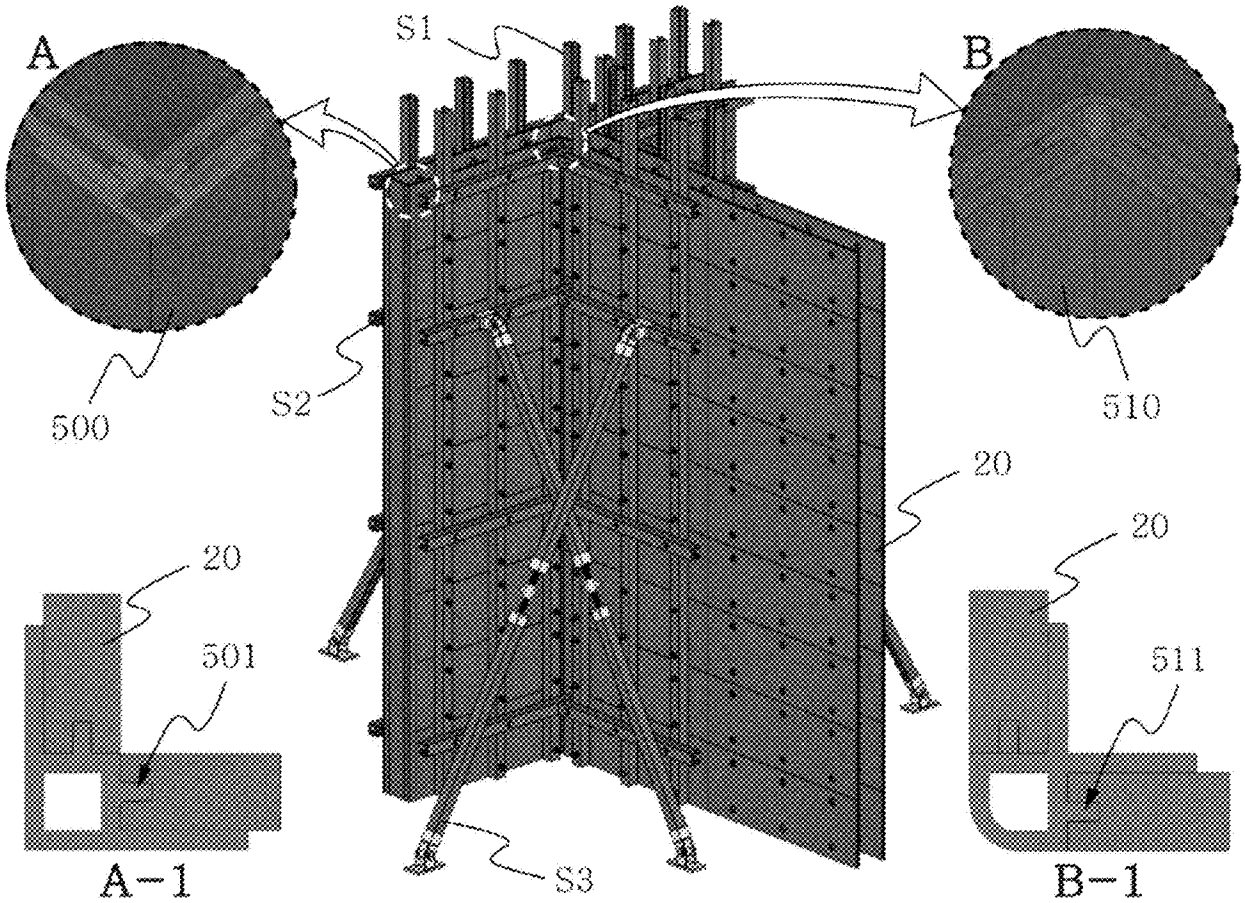
FIG. 13 is a perspective view illustrating a panel, a temporary structure, a brace, and a corner material in use for constructing an inner wall.
Figure 14:
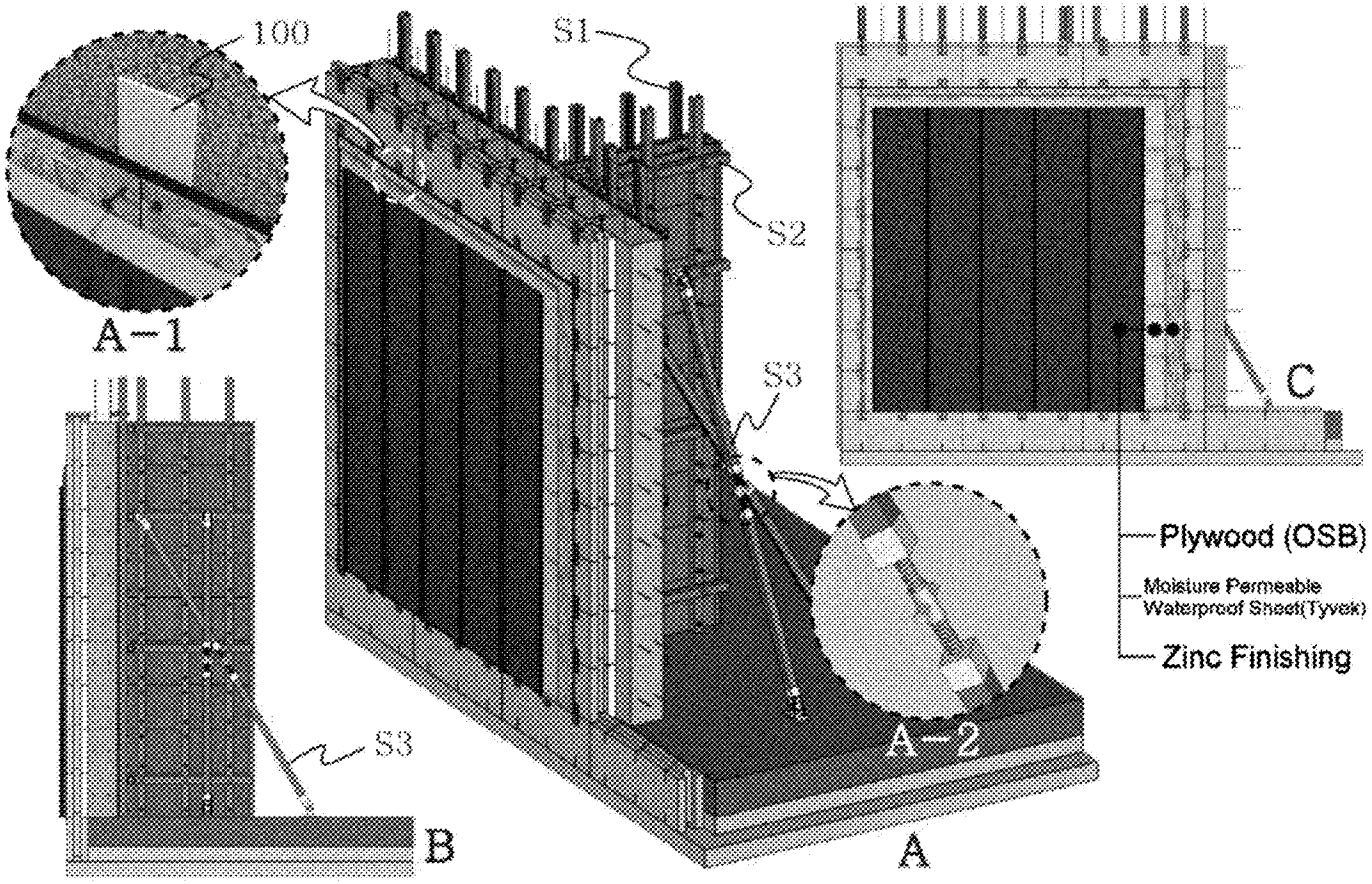
FIG. 14 illustrates a dry finish made after forming an outer wall.
Figure 15:
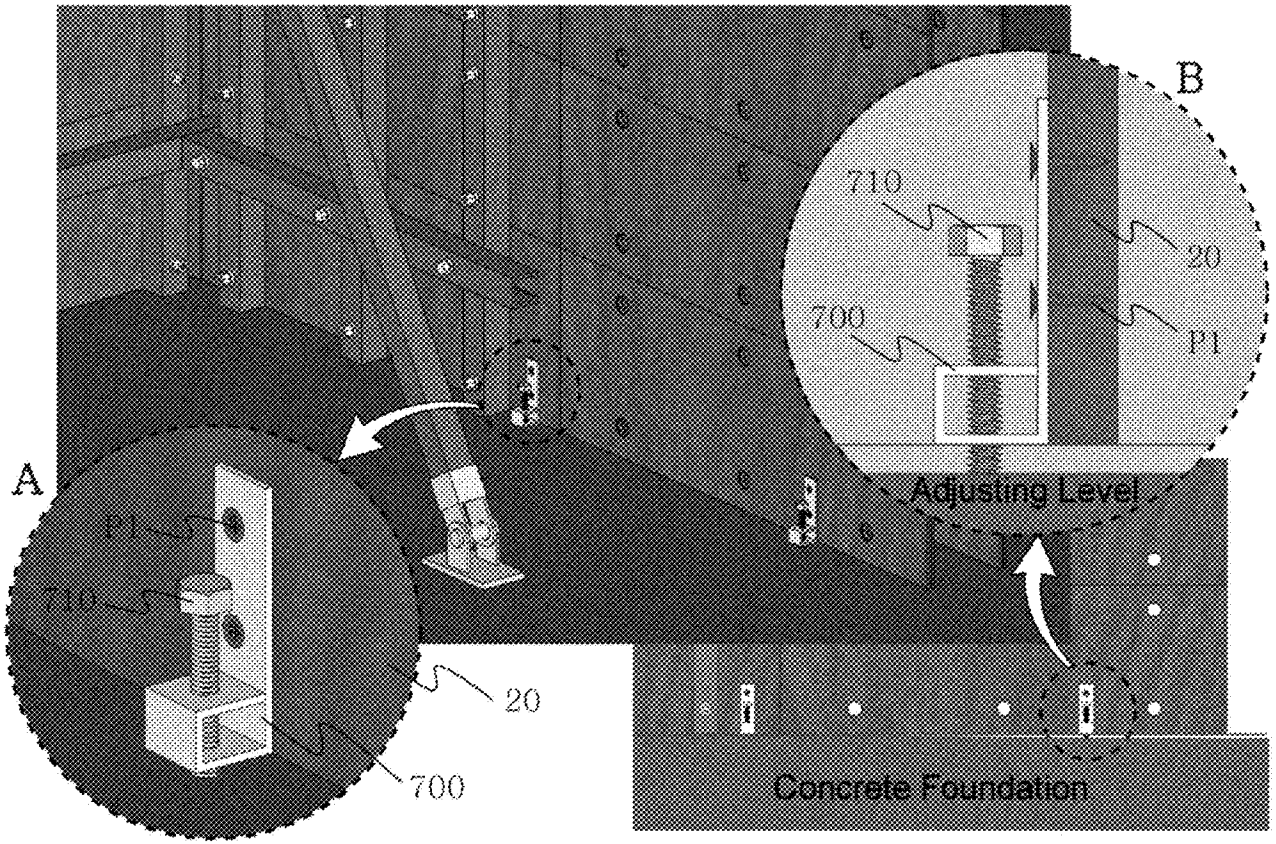
FIG. 15 is a partial detailed view of a leveling device for leveling a floor.
Figure 16:
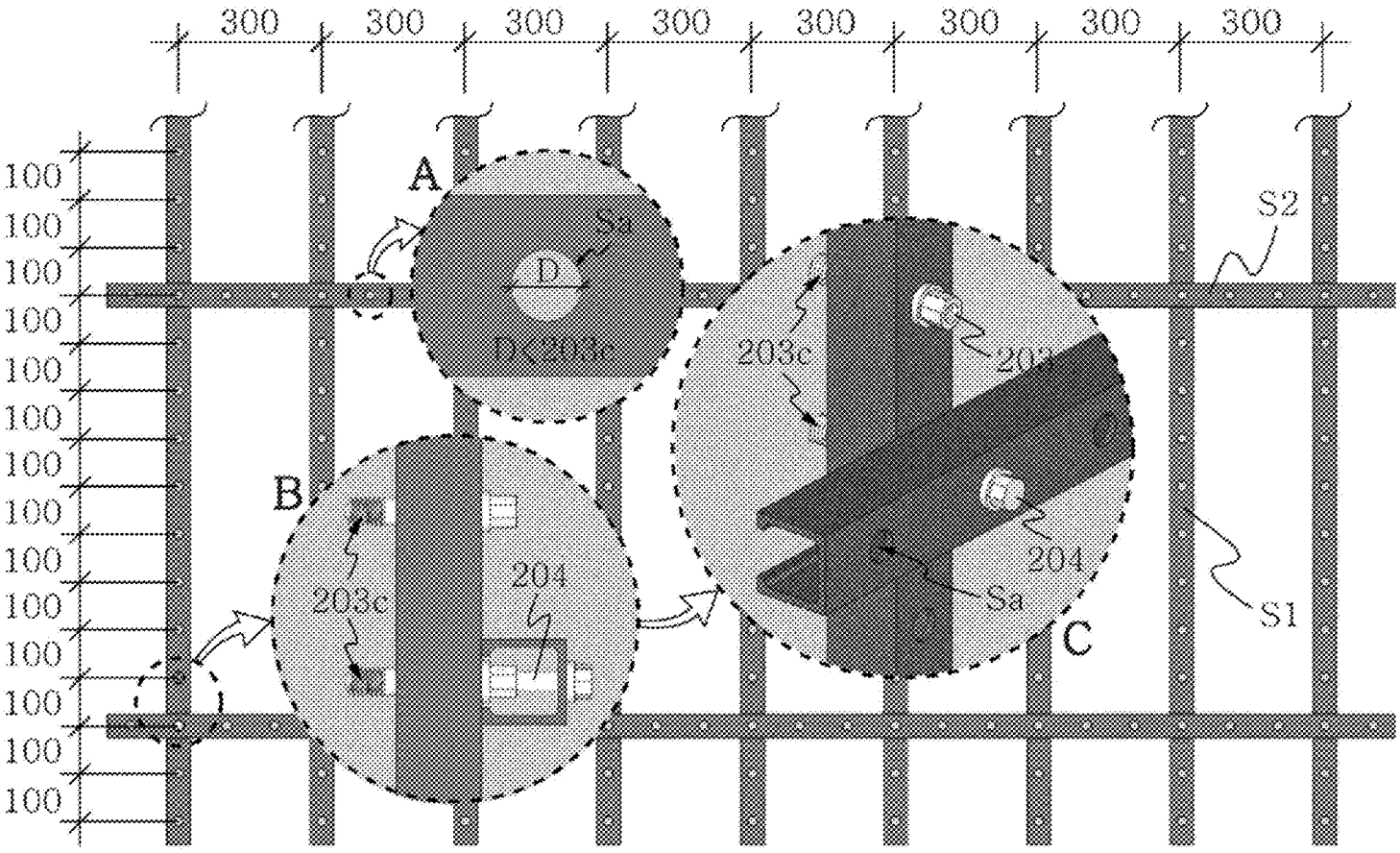
FIG. 16 is a detailed view showing how to arrange and space temporary structures, and how to utilize and fasten temporary structure grooves.

FIGS. 4 and 5 are perspective view and a detailed view of a connector and a connection unit, respectively. The connector connects an insulation plate (not shown) to a panel (not shown constituting an outer wall. FIG. 6 is another perspective view of the devices shown in FIG. 5. FIG. 7 is a perspective view showing how to install two connection units. In FIG. 7, a pair of panels constituting an inner wall is not shown. FIG. 8 is a detailed view showing a heat insulating plate according to an embodiment, an insert groove into which a connector is inserted, a spacing between connector insert grooves, how to install the connector, and how to couple an insulation plate and a connector to each other. FIG. 9 is a perspective view of an embodiment of the present invention and illustrates a panel with a panel coupling insert groove, how to install a panel coupling into the panel coupling insert groove of the panel, a spacing between panel coupling insert grooves, and panel pins, that are inserted into corners at which neighboring panels meet, to secure the neighboring panels to each other. FIG. 10 is a perspective view showing how a panel coupling works, how to disassemble a panel (plywood), and how to detach a panel contacting with a wall after completion of a wall. FIG. 11 is a cross-sectional view illustrating how to connect a heat insulating plate, a panel, and a temporary structure, how to place a reinforcement bar, and how to couple a panel using a heat insulating block system to build an outer wall according to an embodiment of the present invention. FIG. 12 is a cross-sectional view illustrating how to connect a heat insulating plate, a panel, and a temporary structure, how to place a reinforcement bar, and how to couple a panel using a heat insulating block stem to build an inner wall according to an embodiment of the present invention. FIG. 13 is a perspective view illustrating a panel, a temporary structure, a brace, and a corner material in use for building an inner wall. FIG. 14 illustrates how to do a dry finish after an outer wall is formed. FIG. 15 is a partial detailed view of a leveling device utilized for leveling a floor. FIG. 16 is a detailed view showing how to arranging and spacing temporary structures, and how to utilizing and fastening temporary structure grooves.

[Outline of Outer Instillation Integrated Insulation Block System]

The present invention provides a method for replacing a conventional mold construction. An embodiment of the present invention includes a heat insulating plate (10), a panel (20), a connector (100), a connecting unit (200), ties (300, 400), and temporary structures (S1, S2, S3).

The heat insulating plate (10) is fixed on an exterior of an outer wall in an integrated manner when the outer wall is formed, and functions as a mold to support concrete poured when the outer wall is formed.

The panel (20) is placed on an interior of the outer wall (also referred to as "exterior wall"), or on an interior and an exterior of an inner wall (also referred to as "interior wall"). The panel (20) functions as a mold and supports poured concrete when the outer and inner walls (collectively referred to as "walls") are cured. After the walls are cured, the panel may either remain fixed to and integrated with the walls or be separated from the walls. For example, when the panel is made of plywood it can be separated from the walls after the walls are cured. When the panel is made of a plate-like finish material such as a CRC board, it can be held integrated with the walls after the walls are cured.

The connector and the connection unit serve to fix the insulation plate and the panel, respectively, in constructing the walls.

In addition, the temporary structure firmly supports the panel to withstand side pressure of concrete when the concrete is cured. The temporary structure is removed after the concrete curing completes.

The ties are buried in the concrete, along with the reinforcement bars and cured. The ties hold the connector and the connecting unit in place to support the insulating panel and the panel.

According to an embodiment of the present invention, the outer wall is constructed as follows. First, an inner surface of the outer wall is formed. The panel (20) is connected to the lightweight temporary structures (S1, S2, S3) starting from a base corner in a similar manner as building bricks. After the inner surface of the outer wall completes, reinforcements are arranged in a cross manner or in an aligned manner as instructed in a conventional design specification. Then, an outer surface is installed as follows. The connector (100) is positioned corresponding to, the connection unit connected to the inner panel, the insulation panel (10) is installed, and then the concrete is poured and cured. As a result, a high quality wall is obtained with no thermal bridge. According to an embodiment, a dry finish can be done easily. So does as wet finish.

[Connector]

Referring to FIGS. 4 to 6 and 8, the connector (100) is installed in contact with an exterior of a building and is embedded in the heat insulating, plate (10) to hold it.

The connector (100) is formed of a high strength of synthetic resin (for example, engineering plastic) or a material having a low thermal conductivity and capable of minimizing a thermal bridge.

As shown in the drawings, an outer plate (101) of the connector (100) has a wider surface than an inner plate (102) to withstand lateral pressure applied when the concrete is poured. In particular, it is preferable that the outer plate (101) has a size enough to support the heat insulating plate (10) without damaging a surface of the heat insulating plate (10). The heat insulating plate (10) receives a force applied by the side pressure of the concrete when the concrete is poured. On the other hand, the inner plate (102) has such an area enough to be integrated with the insulating plate (10). Thus, the inner plate (102) can have a smaller area than the outer plate (101). In an embodiment, the outer plate (101) is made of 50*100 mm or 60*120 mm to withstand the side pressure applied when concrete is poured.

The outer plate (101) and the inner plate (102) are arranged in parallel to each other and connected to each other by an insert bar (103). The insert bar (103) is in a vertical flat plate shape and extends through an intermediate region. The length of the insert bar (103), that is, the distance between the outer plate (101) and the inner plate (102) can vary depending on a thickness of the heat insulating plate (10). The insert bar (103) may be formed in a single flat plate shape or in a double divided flat plate shape as shown in the drawings. However, to further reduce the thermal bridge, it is more preferable to use a double divided flat plate shape as shown in the drawings. That is, the insert bar (103) ay be formed to have as small sectional area as possible so long as it can firmly connect the outer plate (101) and the inner plate (102) to each other. As shown in FIGS. 8 and 11, the insert bar (103) guides the heat insulating plate (10) to be inserted from a bottom of the connector (100) up to a midway of the connector and also guides the beat insulating plate (10) to be inserted from a top of the connector (100) down to the midway of the connector (100).

As shown in FIG. 6, an outer surface of the outer plate (101) of the connector is provided with a finishing material partitioning line (101*c*). The finishing material partitioning line (101*c*) is in a cross (+) shape and helps a precise finish work.

An inner surface of the outer plate (101) (also referred to as "first surface, of the outer plate") of the connector, an inner surface of the inner plate (102) (also referred to as "second surface of the inner plate"), and both sides of the insert bar (103) are respectively provided with one or more triangular ribs (101*a*, 102*a*, 103*a*) to support and bond the heat insulating plates (10) when the heat insulating plates (10) are inserted from the top and from the bottom of the connector (100). Referring to the drawings, two ribs are provided on an upper portion of the connector, and two additional ribs are provided on a lower portion of the connector.

The inner surface of the outer plate (101) of the connector and the inner surface of the inner plate (102) are provided with stoppers (101*b*, 102*b*) respectively, to define insertion depths of the insulator plate and to uniformly arrange the heat insulating, plate (10). The stoppers (101*b*, 102*b*) are formed to a thickness of 10 to 30 mm, provide inward, and are in a flat plate shape. Thus, the stoppers (101*b*, 102*b*) are perpendicular to the outer and inner plates (101, 102), and perpendicular to the insert bar (103) as well.

As shown in FIGS. 8 and 11, the outer plate (101) and the inner plate (102) of the connector are in contact with an outer surface and an inner surface of the heat insulating plate (10), respectively. A lower portion of the insert bar (103) of the connector is inserted through an insert groove (11) of a lower heat insulating plate (10) and embedded in the lower heat insulating plate. An upper portion of the insert bar (103) is inserted through an insert groove of an upper heat insulating plate and is embedded in the upper heat insulating plate. A bottom of the stopper (101*b*, 102*b*) is in contact with a top of the lower heat insulating plate and limits the insertion depth of the lower heat insulating plate. A top of the stopper (101*b*, 102*b*) is in contact with a bottom of the upper insulating plate and limits the insertion depth of the upper heat insulating plate.

Next, binders (102*c*, 102*d*) are provided on upper and lower portions of the outer surface of the inner plate (102) (also referred to as "first surface of the inner plate") of the connector, respectively, to bind the outer wall tie (300). Each of the binders (102*c*, 102*d*) is in a box shape and integrated with the inner plate (102). A binder groove (102*ch*, 102*dh*) is thrilled in a central upper portion of the binder to keep a hold with the outer wall tie (300). As shown in FIG. 5, the binder groove (102*ch*, 102*dh*) includes a vertical hole and a horizontal groove. The horizontal groove extends from the vertical hole. A first end of the outer wall tie (300) is inserted into the vertical hole. The outer wall tie (300) is aligned in the horizontal groove.

[Connection Unit]

The connection unit (200) facing the inside of a building is fixed to the panel (20) and is preferably made of synthetic resin or metal. The connecting unit (200) includes a panel binder socket (201), a panel coupling (205), a socket bolt (202), a middle bolt (203), and a hex bolt (204) as shown in FIGS. 4 to 7 and FIGS. 11 and 12. Referring to FIG. 11, the panel binder socket (201) is embedded in the concrete wall. The panel coupling (205) is embedded in the panel (20) and integrated with the panel. It is preferable that the connection unit (200), particularly the panel binder socket (201) embedded in the wall, is formed of high strength synthetic resin (e.g., plastic) when the wall is designed to contact an outside air. When the wall is designed as an inner wall and is not in contact with the outside air, the connection unit (200) may be formed of metal material.

The panel hinder socket (201) is provided with a panel binder (201*c*) in which a second, end of the outer wall tie (300) fits. As mentioned above, the first end of the outer wall tie (300) is inserted into the binders (102*c*, 102*d*) of the connector (100). The panel binder (201*c*) may be shaped to, correspond to the binders (102*c*, 102*d*) described above. Likewise, the panel binder groove (201*ch*) may be shaped to correspond to the binder grooves (102*ch*, 102*dh*) described above. When the binder groove and the panel binder groove, which are respectively connected to the first and the second ends of the tie (300), are made in an identical shape, there is no directionality of the tie. Thus, it is convenient for installation.

The panel binder groove (201*c*) is formed on a first surface of the panel binder socket (201). A socket nut (201*b*) is formed on second surface of the panel binder socket (201). The second surface of the panel binder socket (201) is an opposite side to the first surface of the panel binder socket (201). A socket groove (201*a*) is formed around the socket nut (201*b*). The socket nut (201*b*) is engaged with a body bolt portion (202*c*) of a socket bolt (202), which will be described later. The socket groove (201*a*) is engaged with a coupling stick (205*c*) of a panel coupling (205), which will be described later. Since the socket groove (201*a*) is formed in an elongated hole shape, the coupling stick (205*c*) of the panel coupling (205) can be easily inserted theretinto with little burdens of alignment. Upon engagement, the coupling stick (205*c*) is not loosened from the panel binder socket (201). In an embodiment, the panel binder socket (201) is made of plastic while the socket nut (201*b*) is made of metal and obtained using an insert injection method.

It is desirable that an area of the second surface of the panel binder socket (201), which is in contact with the panel (20), is larger than a size of the coupling insert groove (21) formed in the panel. Thus, the panel binder socket (201) can support the panel (20) when a vertical installation member (S1), which will be described later, and the panel (20) are inserted into the socket bolts (202) surface.

Also, the socket groove (201*a*) is formed such a size that can not be easily loosened once it is fastened to the coupling stick (205*c*). Thus, engagement with the panel (20) is made even before the socket bolt (202) and the panel hinder socket (201) are engaged.

The panel coupling (205) is provided to make it easy to separate the panel from a concrete wall once the concrete is poured and cured. The panel is in contact with the concrete wall. Therefore, the panel coupling (205) is not necessary for a wall-integrated type panel (in which a CRC board or a magnesium board is integrated with the concrete wall after the concrete wall is cured). In contrast, the panel coupling (205) may be necessary for a wall-separate type panel (plywood or resin panel) since the panel is removed from the concrete wall after the concrete wall is cured.

As shown in FIGS. 5, 6, 9, and other drawings, the panel coupling (205) includes a coupling latch (205*b*) a coupling stick (205*c*), a female coupling screw (201*a*), and a coupling panel fixing pin (205*d*). The coupling latch (205*h*) is in a hook shape so that the panel (20) is not pulled out once it is inserted into the panel (20). The coupling stick (205*e*) is engaged with the panel binder socket (201). The female coupling screw (205*a*) is engaged with the screw (600*a*) of the coupling panel wrench (600), which will be described later. The coupling panel fixing pin 205*d*) prevents the panel coupling (205) fitted in the panel (20) from being idle in the panel.

The coupling stick (205*c*) tightly fits the socket groove (201*a*) so that the coupling stick (2050) hardly fall off once it is inserted into the socket groove (201*a*). As a result, the panel and the binder socket (201) are temporarily engaged with each other. Rotation of the coupling stick (205*c*) inserted into the socket groove (201*a*) is interfered with the socket groove (201*a*). Thus, even when the female coupling screw (205*a*) of the panel coupling (205), which is screwed into the coupling screw (205*a*) of the coupling panel wrench (600), rotates, the panel coupling (205) is not rotating together with the coupling panel wrench (600). The coupling panel fixing pin (205*d*) also helps prevent rotation of the panel coupling (205).

The socket bolt (202) is a component for fastening the panel binder socket (201) to the panel (20). To perform a typical bolt function, a socket bolt head (202*a*) has a polygonal head shape, and a socket bolt body bolt portion (202*c*) has a thread shape. The body bolt portion of the socket bolt (202*c*) is fastened to the socket nut (201 *b*) of the panel binder socket (201), thereby fixing the panel binder socket (201) to the panel (20).

The socket bolt head (202*a*) is provided with a socket bolt head nut portion (202*b*). The socket bolt head nut portion (202*b*) is in the form of a female screw and fastened to the middle bolt (203) so that the vertical temporary structure (S1) (to be described later) is fixed to the panel (20).

Similar to the socket bolt, the middle bolt (203) performs a typical bolt function and has a middle bolt head (203*a*) and a body part. The middle bolt head (203*a*) is in a polygonal shape, and the body part is in a thread-like shape. The middle bolt body part is fastened to the head nut portion (202*b*) of the socket bolt (202). As a result, the panel (20) and the vertical temporary structure (S1) are fixed to each other.

The middle bolt head (203*a*) is further provided with a middle bolt head nut portion (203*b*). The middle bolt head nut portion (203*b*) is in a female screw shape and is fastened to the hex bolt (204), thereby engaging the horizontal temporary structure (S2) (which will be described later) with the vertical temporary structure (S1).

The hex bolt (203) functions as a typical bolt and includes a hex bolt head (204) and a hex, bolt body part (204*b*). The hex bolt head (204*a*) is in a polygonal shape, and the hex bolt body pan (204*b*) is in a thread shape. The hex bolt body part (204*b*) is fastened to the head nut portion (203*b*) of the middle bolt (203), thereby engaging the vertical and horizontal temporary structures (S1, S3) together. In an embodiment of the present invention, unlike the socket bolts and the middle bolts, the hex bolt head (204*a*) is not required to be in a female screw shape.

As shown in FIGS. 4 to 6 and 11, the connection unit (200) utilizes the connector (100) and the tie (300) to form the outer wall. In contrast, as shown in FIGS. 7 and 12, two connecting units (200) are arranged to face each other and are connected to each other using an inner wall tie (400) to form the inner wall. Such structure enables various modifications. Accordingly, the panel binder groove (201*ch*) of the panel binder socket (201) can be engaged with either the inner wall tie (400) or the outer wall tie (300).

The socket screw (201*b*) of the panel binder socket (201) has such a size as engageable with the socket bolt body screw (202*c*) of the socket bolt (202). However, the socket screw (201*b*) is formed smaller than the screw (600*a*) of the coupling panel wrench (600). Thus, when the concrete wall is cured and the panel (20) is separated from the concrete wall, the socket screw (201*b*) of the panel binder socket (201) cannot be engaged with the coupling panel wrench (600).

On the other hand, the female coupling screw (205*a*) formed, on the inner wall of the panel coupling (205) is larger than the socket bolt body screw (202*c*) of the socket bolt (202). Thus, the female coupling screw (205*a*) is not engageable with the socket bolt (202). In contrast, the female coupling screw (205*a*) has such a size as engageable with the screw (600*a*) of the coupling panel wrench (600). Thus, as shown in FIG. 10, when the panel (20) is detached after the curing of the concrete wall, the female coupling screw (205*a*) is pushed out away from the concrete wall.

[Ties]

There are two kinds of ties, an outer wall tie (300) and an inner wall tie (400). Usually, there is no need to distinguish them from each other. Typically, however, the outer wall is made thicker than the inner wall. The outer wall tie (300) and the inner wall tie 400 may have different lengths from each other. The outer wall tie (300) and the inner wall tie (400) vary in length depending on the type and thickness of a given wall.

The outer wall tie (300) connects the connector (100) and the connection unit (200) and keeps a gap therebetween. The outer wall tie (300) is embedded in the concrete wall and withstands a pressure applied by the concrete when it is poured. For this purpose, the outer wall tie (300) is preferably formed of metal having a strong tensile force, e.g., a iron wire.

The outer wall tie (300) connecting the connector (100) and the connecting unit (200) is preferably a hook. Both ends of the outer wall tie (300) have the same shape and are symmetrical to each other.

[Insulating Plate]

Referring to FIG. 8, when used to form the outer wall, the heat insulating plate (10) may have a size of 900 mm in width, 300 mm in length, and 150 mm in thickness, for example. Preferably, the dimension of the heat insulating plate may be set so that deformation does not the heat insulating plate may be adjusted in consideration of the size of the outer plate (101) of the connector (100) and the strength of the heat insulating plate.

The insulating plate (10) is formed to such a thickness as meeting the energy saving design standards of Regulations of the Building Act. For waterproofing and prevention of linear thermal bridging, a joint between the heat insulating plate (10) and the heat insulating plate (10) is shaped into an angled protrusion (D in FIG. 8) when formed at upper and right surfaces. The joint is shaped into an insertion groove when formed at a lower surface and at a left side surface (E in FIG. 8) and fits the protrusion.

A connector insert groove (11) is formed at the heat insulating plate from a top to a bottom or from a bottom to a top. The connector insert groove (11) is formed to such a depth that the connector (100) can be inserted. See B and C shown in FIG. 8. The depth is approximately 30 to 60 cm.

The insulating plate (10) is preferably made of a light-weight material with an insulation property sufficient to satisfy a given standard, e.g., the National Accredited Test Standard. The EPS, Neopor, XPS, gold foam, and polyurethane foam can be used as the insulating plate (10).

The shape of the heat insulating plate (10) may be an integral form or a laminated form (for example, a joint of an EPS and an XPS, a joint of an inorganic plate type panel having a fire resistance such as an organic plate heat insulating plate, a CRC board, and a magnesium board). The laminated layers may be bonded to each other using a homo-type or hetero-type adhesive. The adhesive may be polyurethane or vinyl resin having an excellent weather resistance, moisture resistance, impact resistance, and waterproofness.

The laminated structure can minimize the disadvantages and to maximize advantages the insulating material has. Expanded polystyrene (EPS) made by a bead method is not preferred since the EPS has a characteristic of absorbing water when directly contacting with water. Thus, insulation performance of EPS gets deteriorated over time. On the other hand, XPS obtained by an extrusion method does not absorb water. Thus, XPS may be suitable for use in a underground-level structure exposed to a moisturized circumstance. However XPS is more expensive than EPS and thus is not cost-effective for a architecture material.

Considering characteristics of respective heat insulating materials, it is preferable to form the heat insulating plate in a lamination of XPS and EPS. For example, XPS is used to form a portion in contact with the concrete wall and EPS or Neopor is used to form a portion exposed to outside.

[Panel]

When using the panel (20), the wall can be formed without using an existing steel form (euroform).

As shown in FIG. 9, the size of the panel (20) is preferably the same as that of the heat insulating plate (10) (for example, 900 mm in width and 300 mm in length). But the size may change depending on user's intention. Rather, it is more important to locate the connector (100) at a position corresponding to the coupling insert groove (21) of the panel (20). It is also important to keep a constant distance between the binders (102*c*, 102*d*) of the connector (100), which is inserted into the heat insulating plate (10), and the coupling insert grooves (21) located at the panel (20).

The coupling insert groove (21) is formed in such a size and structure into which the panel coupling (205) can be inserted (refer to A, B, and C in FIG. 9). The panel coupling (205) has such a diameter that it fits the socket bolt (202) (refer to D FIG. 9).

Grooves are formed on the upper, lower, left, and right sides of the panel (20). Panel pins (520) can be inserted in the grooves (refer to E and F in FIG. 9). The panel pins are inserted into holes formed at which two panels (20) are connected. The holes are formed in such widths and depths suitable for the panel pins (520) to be inserted. The panel pins (520) may be formed in long strips, and inserted into the grooves on the upper, lower, right, and left sides of the panel (20), respectively. The cross section of the panel pin (520) is in a symmetrical rhombus shape as shown in the drawings.

The panel pin (520) may be used to connect two panels side by side. The panel pin (520) serves as an in-corner member or an out-corner member (500) and connects two panels which are vertically connected at an in-corner or at an out-corner. In detail, as shown in A and A-1 of FIG. 13, the out-corner member (500) includes extensions, sidewalls, and ribs (501). The extensions respectively extend over to given lengths to cover exteriors of two panels which are vertically connected at the out-corner. The ribs (501) are in diamond shapes and fit in the coupling insert grooves (21), respectively. The coupling insert grooves (21) are formed on side surfaces of the two panels which are vertically connected at the out-corner. In practice, the out-corner member is not in direct contact with the concrete wall.

As shown in FIGS. 13B and B-1, the in-corner member (510) also includes extensions, sidewalls, and ribs (511). The extensions extend over to a given length to cover exteriors of two panels that are vertically connected at an in-corner. The ribs (511) are respectively in rhombic shapes and fit in the coupling insert, grooves (21) formed on the side surfaces of the two panels which are vertically connected at the in-corner. An inner side of the in-corner member is in contact with the concrete and is formed into an arc shape. Thus, an in-corner of the concrete wall is formed in a natural shape.

When used to build an integrated-type panel, the inner-corner and outer-corner members can switch their roles. As described above, when the panels (20) is designed to be separated from the wall after the concrete wall completes, the out-corner member (500) is provided at the out-corner, and the in-corner member (510) is provided at the in-corner. In contrast, when used to build a later-separated-type panel (20), it is desirable to minimize the area of the corner members (500, 510) exposed to outside, in other words, in a wall-panel-integrated design, detachment work of the panel is not required. Therefore, the in-corner member (510) may be installed at the out-corner as shown in FIG. 9A, and the out-corner member (500) may be installed at the in-corner as shown FIG. 9B. Under this structure, only the arc portion of the in-corner member (510) provided at the out-corner is exposed to outside, and the out-corner member (500) provided at the in-corner is not exposed to outside at all.

When the panel (20) is a wall-integrated type and is not separated from the concrete wall, a commercial inorganic material such as a CRC board and a magnesium board can serve as the panel to prevent toxic gases in the event of fire. It is preferable to use an eco-friendly material. Moreover, for a wall-panel-integrated type panel, it is preferable to form pores (not shown) ire the panel to control moisture contained in the concrete wall. It is also desirable to form the pores on the entire surface of the panel. The pores are arranged at intervals of 30 to 100 mm to form a horizontal and vertical grating. The pores may be formed 3~10 mm or less in size and the size may vary depending on moisture permeability of the panel.

For a wall-panel-separated structure, the panel is detached and then a plaster finish follows. In this case, the panel may be a mold product such as commercial plywood (waterproof plywood) and synthetic resin. The panel can be easily performed using the panel coupling (205), which is one component of the panel connecting unit (200), in reference to FIG. 10.

[Temporary Structures]

The temporary structures will be described below in reference to FIGS. 11 and 16.

The temporary structures (S1, S2, S3) serve to evenly disperse the side pressure by the wall and support the panel (20). Each of the cross sections of the vertical temporary structure (S1) and horizontal temporary structure (S2) is formed into an angular U shape or a "[" shape. See FIG. 16. The holes (Sa) are arranged at intervals of 10 cm in a longitudinal direction. The hole (Sa) is preferable to have a diameter larger than the diameter of the body bolt portion of the middle bolt (203) or the diameter of the body bolt portion of the hex bolt (204). The diameter of the hole (Sa) is smaller than the diameter of the heads (203*a*, 204*a*). See A of FIG. 16. The middle bolts (203) of the connection unit (200) are fixed to the vertical temporary structure (S1) at every 30 cm in the lateral direction. It is also preferable that three or more of the horizontal temporary structures (S2) are installed on the vertical temporary structure (S1). The number of the horizontal temporary structures (S2) may vary depending on the height of the bracket (S3). The vertical temporary structure (S1) is fixed to the panel (20) by the head nut portion (202*b*) of the socket bolt (202) and the body bolt portion (203*c*) of the middle bolt (203) exposed on the panel (20). The horizontal temporary structure (S2) is fixed to the vertical temporary structure (S1) by the head nut portion of the middle bolt (203), which is exposed on the vertical, temporary structure (S1), and the body bolt portion (204*b*) of the hex bolt (204). One end of the brace (S3) is fixed to the horizontal temporary structure and the other end is fixed to the floor.

The hex bolt (204) is the final finishing component and protrudes to the outermost side. The hex bolt (204) has no sharp metal protrusion and thus is safe for workers to handle and advantageous in preventing an accident.

The brace (S3) has a turnbuckle (S3*a*) to adjust the length of the brace (S3) for vertical adjustment of the wall. See A-2 in FIG. 14. The wall may be leveled using the turnbuckle (S3*a*) of the brace (S3) once the wall is installed.

Material for the temporary structures (S1, S2, S3) is not limited. Metal or synthetic resin can be used. Synthetic resin is superior in bending strength, corrosion resistance, and lightweight.

Unlike a conventional method, a lightweight (synthetic resin) material is applicable to the present invention. The panel (20) and the temporary structures (S1, S2) may be installed at the same time. In another embodiment, the insulating block (panel, insulating plate, connector, connecting unit) is formed first, and then the temporary structure is installed.

[Leveling Device]

FIG. 15 is a detailed view showing how to use a leveling device to level the floor.

A leveling device (700) is a tool holding the panel (20) horizontally when the panel is installed on an irregular concrete foundation. According to the present invention, leveling is simple and easy. The leveling device (700) is fixed to the panel (20) using a screw (P1). Compared with a conventional construction method, there is no hassle such as memodo work using an additional leveler.

In detail, the leveling device (700) is an inverted 'P' shape. A groove is formed at an end surface of the leveling device. The end surface is in close contact with the panel (20). At least one screw (P1) passes through the groove. A vertical through-groove is formed in a box-shaped adjuster. A leveling bolt (710) is fastened into or loosened from the vertical through-groove for a fine height adjustment.

One or more leveling devices (700) are installed on the panel (20) when necessary. Leveling is made by adjusting the leveling bolts (71) in consideration of a gradient of a bottom surface and unevenness of the bottom surface.

[Construction of Outer Wall]

Referring to FIGS. 4 to 6, 11 and 14, the outer wall is installed as follows. First, according to a given construction specification, installation may proceed starting from a corner toward an inner side using the panel (20). When the panel (20) is installed at the lowermost level, the leveling device (700), the screw (P1), or the leveling bolts (710) may be necessary for leveling depending on the gradient of the bottom.

According to an embodiment, the panel (20) is set up first and then, the panel binder socket (201) is fixed to the panel (20) later. In another embodiment, the panel binder socket (201) is fixed to the panel (20) first, and then the panel is set up later. The panel binder socket (201) is fixed to the panel (20) as follows. First, the panel hinder sockets (201) are fixed to the inner surface of the panel (20) by the socket grooves (201*a*) and the coupling sticks (205*c*). Then, the socket, bolts (202) and the panel binder sockets (201) are engaged with each other, thereby fixing the panel binder sockets (201) to the panel (20).

Adjoining panels (20) are connected to each other by inserting the panel pin (520) into the coupling insert groove (21) and by using the out-corner member (500) or the in-corner member (510) at a corner.

The temporary structure is installed as follows. The vertical temporary structure (S1) is placed on the socket bolt (202) exposed onto the panel (20) and fixed using the middle bolt (203) and the socket bolt (202). The horizontal temporary structure (S2) is placed on the middle bolt (203) exposed onto the vertical temporary structure and fixed using the middle bolt (203) and the hex bolt (204). The vertical temporary structures (S1) may be arranged at intervals of 30 cm, and the number of the horizontal temporary structures (S2) may be three or more. The number may vary depending on locations of the braces (S3). One end of the strut (S1) is connected to one of the horizontal temporary structure (S2) located at an appropriate level. The other end of the strut (S3) is fixed to the floor. Then, verticality of the panel (20) is adjusted using the turnbuckle (S3*a*). Flatness and verticality of the wall is continuously adjusted using the turnbuckle (S3*a*) of the brace (S3) and the leveling bolt (710) during the entire construction process. The leveling device may be installed at the initial stage, in the middle of construction, or after completion of the panel installation.

Next, vertical reinforcement (DB1) and horizontal reinforcement (DB2) are laid out according to a given building specification and drawings.

The outer wall tie (300) is bound to the socket groove (201*a*) of the panel binder socket (201). The socket groove (201*a*) of the panel binder socket (201) is a component of the connection unit (200) which is fastened to the panel (20). After inserting the connector (100) into the connector insert groove (11) of the heat insulating plate (10), the heat insulating plate (10) is placed to be correspond to the external wall tie (300).

Concrete is poured between the heat insulating plate (10) and the panel (20). Then, the concrete is cured.

After curing, the hex bolts (204), the middle bolts (203), and the socket bolts (202) are loosened and the temporary structures (S1, S2, S3) are removed in the reverse order.

When the panel (20) is a wall-integrated type, the inner surface of the outer wall may be finished on the panel (20). When the panel (20) is a wall-separated type, the panel (20) is detached and finish is made on the wall.

When the panel is a wall-separated type as shown in FIG. 10, when the coupling panel wrench (600) coupled to the electric drill is rotated into the panel coupling (205) in a conventional bolt tightening manner, the coupling panel wrench (600) is engaged with the female coupling screw (205*a*) of the panel coupling (205) and inserted in. When the coupling panel wrench (600) is inserted to the depth of the panel, a front end of the coupling panel wrench (600) contacts the concrete wall and rotates. Then, the panel coupling (205) is pushed out along the screw (600*a*) formed on an outer periphery of the coupling panel wrench (600). As a result, the panel (20) is detached from the wall. Repeating this work may easily separate the panel away from the wall.

When the panel is a wall-integrated type, a finish work onto the inner surface of the outer wall can be done by directly applying the wallpaper or paint finish. When the panel is a wall-separated, type, plater may or may not be applied depending on a condition of the wall. Then, a wall paper or a paint finish may be done.

This method utilizes a high-energy preserving capacity of a concrete wall, instead of using a conventional gypsum board. This method can maximize energy, storage performance. The finish onto e inner surface of the outer wall is advantageous in energy saving and keeping the wall temperature constant over the entire wall. This structure effectively blocks mold or dew condensation.

FIG. 14 shows a dry finishing state. Various finish materials can be used without additional work for a finish on the outer surface of the outer wall.

The reason this process is possible under the present invention is because the outer surface of the outer plate (101) of the connector (100) is exposed to outside of the outer wall of the heat insulating block system. That is, since the connector (100) is exposed to outside of the heat insulating plate (10), a dry finish can be done without any additional preliminary work. See A and C shown in FIG. 8 and A-1 shown in FIG.

A significant difference between an exterior finish according to an embodiment of the present invention and a conventional dry finish is that the finishing material (e.g., a CRC board, a wood panel, a metal panel Etc.) can be directly applied without damaging the insulation and without any additional preliminary work.

When the outer finish is made with a wet-finish (e.g., dry bit, stucco, terra-coat, etc.), a wet insulation board (not shown) may serve as the heat insulator. The connector (100) is embedded in the heat insulator. Alternatively, the same construction method as a conventional wet plastering method can still be used.

According to an embodiment of the present invention, a heat insulating plate (10) located outside a floor base surface and a heat insulating plate (10) forming the wall can be continuously connected to each other. Thus, cold air coming from outside can be effectively shut off, and a thermal bridge can be prevented. See FIG. 14.

As described above, according to an embodiment of the present invention, construction time can be shortened, construction cost can be saved, construction waste can be reduced, and an eco-friendly building is obtained. The present invention may provide a high quality reinforced concrete wall system and a convenient finish process.

[Construction of Inner Wall]

Next, how to build the inner wall will be described below with reference to FIGS. 7, 12, and 13. The following explanation will be focus on differences from how to build the outer wall. The features same as or similar to how to build the outer wall will be omitted for conciseness. Explanation on well-known technique will be omitted as well.

While one side of the outer wall is formed with the heat insulating plate (10) and the connector (100), both sides of the inner wall are formed with the panels (20). That is, a heat insulating material does not need to be installed on the inner wall. Thus, the panel (20) and the connecting unit (200) are formed on both sides of the inner wall. See FIG. 7. Then, the two panels are connected to each other using the inner wall tie (400). The inner wall may be reinforced if required. The inner wall system may be widely applicable to various structures (e.g., a pillar, a retaining wall, etc.), except for a regular wall which does not require heat insulation. An integrated-type or detachable-type panel (20) can be selected depending on cost efficiency and purposes of a given construction.

Preferred embodiments of the present invention have been described above. However, the present invention is not limited to the above specific embodiments. It will be apparent to persons having ordinary skills in the art that numerous modifications and variations are available without departing from the spirit or scope of the appended claims. Also, its equivalents should be considered to be within the scope of the present invention.

What is claimed is:

1. An insulating block system comprising:

a first panel (20) defining a first surface of a wall and including first and second coupling insert grooves (21), wherein the first and second coupling insert grooves are spaced apart from each other by a predetermined distance in a left-right direction, in a top-bottom direction, or in a top-bottom-left-right pattern;

a connection unit (200) fixed to the first panel;

a temporary structure (S1, S2, S3) detachably fixed to the first panel by the connection unit and supporting a side pressure applied by a concrete; and a structure defining a second surface of the wall and facing an inner surface of the first panel, spaced apart from the first panel, and fixed to the first panel by a tie (300, 400), wherein the tie is engageable with the connection unit, wherein the connection unit (200) includes:

a panel binder socket (201) engageable with a first end of the tie (300, 400) and fixed to the inner surface of the first panel; and a bolt (202, 203, 204) provided on an outer surface of the first panel, engageable with the panel binder socket (201) to fix the first panel (20) to the panel binder socket (201), and fixing the temporary structure to the outer surface of the first panel, wherein the structure defining the second surface of the wall is a heat insulating plate (10), wherein a connector (100) is installed in the heat insulating plate (10) and coupled to a second end of the tie (300), wherein the connector (100) comprises an inner plate (102) and an outer plate (101) which are spaced apart from each other with a gap, wherein at least a part of the heat insulating plate (10) is inserted in the gap, wherein the heat insulating plate (10) includes a lower heat insulating plate and an upper heat insulating plate, wherein at least a part of the lower insulating plate is inserted up between the inner plate (102) and the outer plate (101), wherein at least a part of the upper insulating plate is inserted down between the inner plate (102) and the outer plate (101), wherein the inner plate (102) faces the wall, wherein the outer plate (101) is close to outside.

2. The insulating block system of claim 1, wherein the connector (100) further comprises an insert bar (103), wherein the insert bar (103) is in a vertical flat plate shape and connects the inner plate (102) and the outer plate (101) to each other, wherein a lower portion of the insert bar (103) is inserted into a first insert groove (11) to a first given depth in a first direction perpendicular to an upper surface of the lower heat insulating plate, wherein the first insert groove (11) is formed in the lower heat insulating plate, wherein an upper portion of the insert bar (103) is inserted into a second insert groove (11) to a second given depth in a second direction perpendicular to a lower surface of the upper heat insulating plate, wherein the second insert groove (11) is formed in the upper heat insulating plate.

3. The insulating block system of claim 2, wherein the connector (100) further comprises a stopper, wherein the stopper protrudes inwardly from a second surface of the inner plate or a first surface of the outer side plate in a third direction, wherein the third direction is perpendicular to the inner plate (102), the outer side plate (101), and the insert bar (103), wherein the second surface of the inner plate and the first surface of the outer plate face each other, wherein the stopper is formed at a midway level between a top and a bottom of the inner plate or the outer plate, wherein a bottom of the stopper contacts the upper surface of the lower heat insulating plate and defines a first insertion depth up to which the lower heat insulating plate is inserted, wherein a top of the stopper contacts the lower surface of the upper heat insulating plate and defines a second insertion depth down to which the upper heat insulating plate is inserted.

4. The insulating block system of claim 1, wherein the connector (100) further comprises a binder groove (102*ch*, 102*dh*), wherein the binder groove (102*ch*, 102*dh*) is formed in a binder (102*c*, 102*d*) and engageable with the second end of the tie (300), wherein the binder (102*c*, 102*d*) is formed on a first surface of the inner plate (101), wherein the first surface of the inner plate (101) faces the wall.

5. An insulating block system comprising:

a first panel (20) defining a first surface of a wall and including first and second coupling insert grooves (21), wherein the first and second coupling insert grooves are spaced apart from each other by a predetermined distance in a left-right direction, in a top-bottom direction, or in a too-bottom-left-right pattern;

a connection unit (200) fixed to the first panel;

a temporary structure (S1, S2, S3) detachably fixed to the first panel by the connection unit and supporting a side pressure applied by a concrete; and a structure defining a second surface of the wall and facing an inner surface of the first panel, spaced apart from the first panel, and fixed to the first panel by a tie (300, 400), wherein the tie is engageable with the connection unit, wherein the connection unit (200) includes:

a panel binder socket (201) engageable with a first end of the tie (300, 400) and fixed to the inner surface of the first panel; and a bolt (202, 203, 204) provided on an outer surface of the first panel, engageable with the panel binder socket (201) to fix the first panel (20) to the panel binder socket (201), and fixing the temporary structure to the outer surface of the first panel, wherein the panel binder socket (201) comprises:

a surface facing the panel and an opposite surface;

a socket nut (201*b*) formed on the surface facing the panel and engageable with the bolt, wherein the bolt is inserted through the first panel from the outer surface of the first panel through the first coupling insert groove (21); and a panel binder (201*c*) formed on the opposite surface and engageable with the tie (300, 400).

6. The insulating block system of claim 5, wherein a panel coupling (205) is provided in the first coupling insert groove (21), wherein a female coupling screw (205*a*) is provided in the panel coupling (205), wherein the female coupling screw (205*a*) has a first diameter and is engageable with a screw (600*a*) of a coupling panel wrench (600), wherein the first diameter of the bolt is smaller than the female coupling screw (205*a*) and is not engageable with the female coupling screw (205*a*), wherein a coupling stick (205*c*) protrudes from the panel coupling (205) and faces the panel binder socket (201), wherein a socket groove (201*a*) is formed on the panel binder socket (201) facing the panel coupling (205), wherein the coupling stick (205*c*) is inserted into the socket groove (201*a*).

7. The insulating block system of claim 5, wherein the bolt comprises:

a socket bolt (202) coupled to the panel binder socket (201) and fixing the panel binder socket (201) to the first panel (20);

a middle bolt (203) coupled to a head nut portion (202*b*) formed on the head (202*a*) of the socket bolt (202) and fixing the temporary structure (S1) to the outer surface of the first panel (20) with having the temporary structure (S1) interposed between the first panel (20) and the middle bolt (203); and a hex bolt (204) coupled to a head nut (203*b*) formed on a head (203*a*) of the middle bolt (203) and fixing the temporary structure (S2) to the temporary structure (S1) with having the temporary structure (S2) interposed between the temporary structure (S1) and the hex bolt (204).

8. The insulating block system of claim 5, wherein a third panel is provided adjacent to the first panel and arranged with the first panel side by side, wherein first and third grooves are respectively formed on side surfaces of the first panel (20) and the third panel and face each other, wherein a panel pin (520) fits in the first and the third grooves.

9. The insulating block system of claim 5, wherein a fourth panel is provided adjacent to the first panel and arranged in perpendicular to the first panel, wherein a fourth groove is formed on a side surface of the fourth panel and faces the first groove, wherein a first rib (501) of an out-corner member (500) or a second rib (511) of an in-corner member (510) fits in the first and the fourth grooves.

10. The insulating block system of claim 9, wherein the out-corner member (500) includes a first extension which extends over and covers outer surfaces of the first and the fourth panels by a predetermined length, wherein the in-corner member (510) includes a second extension which extends over and covers outer surfaces of the first and the fourth panels by a predetermined length.

11. An insulating block system comprising:

a first panel (20) defining a first surface of a wall and including first and second coupling insert grooves (21), wherein the first and second coupling insert grooves are spaced apart from each other by a predetermined distance in a left-right direction, in a too-bottom direction, or in a top-bottom-left-right pattern;

a connection unit (200) fixed to the first panel;

a temporary structure (S1, S2, S3) detachably fixed to the first panel by the connection unit and supporting a side pressure applied by a concrete; and a structure defining a second surface of the wall and facing an inner surface of the first panel, spaced apart from the first panel, and fixed to the first panel by a tie (300, 400), wherein the tie is engageable with the connection unit, wherein the connection unit (200) includes:

a panel binder socket (201) engageable with a first end of the tie (300, 400) and fixed to the inner surface of the first panel; and a bolt (202, 203, 204) provided on an outer surface of the first panel, engageable with the panel binder socket (201) to fix the first panel (20) to the panel binder socket (201), and fixing the temporary structure to the outer surface of the first panel, wherein the insulating block system further comprises:

a leveling device (700) provided at a lower portion of the first panel; and a leveling bolt (710) engageable with the leveling device (700), arranged toward the ground, wherein a coupling depth of the leveling bolt is adjusted to level the first panel horizontally.

* * * * *